US005338891A

United States Patent [19]

Masubuchi et al.

[11] Patent Number: 5,338,891

[45] Date of Patent: Aug. 16, 1994

[54] MUSICAL TONE CONTROL DEVICE WITH PERFORMING GLOVE

[75] Inventors: Takamichi Masubuchi; Katutoshi Kouchi, both of Hamamatsu, Japan

[73] Assignee: Yamaha Corporation, Hamamatsu, Japan

[21] Appl. No.: 890,575

[22] Filed: May 28, 1992

[30] Foreign Application Priority Data

May 30, 1991 [JP] Japan ..... 3-127294

[51] Int. Cl.[5] ..... G10H 1/053; G10H 1/18; G10H 1/46

[52] U.S. Cl. ..... 84/600; 84/658; 84/666; 84/670

[58] Field of Search ..... 84/600, 615, 626, 633, 84/644, 653, 658, 666, 670, 678, 687–690, 711, 718

[56] References Cited

U.S. PATENT DOCUMENTS 5,105,708 4/1992 Suzuki et al. ..... 84/600
5,119,709 6/1992 Suzuki et al. ..... 84/600
5,166,462 11/1992 Suzuki et al. ..... 84/600
5,177,311 1/1993 Suzuki et al. ..... 84/600

FOREIGN PATENT DOCUMENTS 1-315791 12/1989 Japan .
2-135395 5/1990 Japan .
2-244199 9/1990 Japan .
2-273791 11/1990 Japan .

*Primary Examiner*—Stanley J. Witkowski
*Attorney, Agent, or Firm*—Graham & James

[57] ABSTRACT

The electronic musical instrument is constructed such as to detect key-on/key-off performed by physical flexion movements of fingers through a pair of performing gloves 1 and 2 so as to effect generation and erase of musical tones in real timings practically matching with fingering performance. An A/D converter 3 converts signals from bend sensors 10 of the performing gloves 1, 2 into digital flexion data. A controller 4 processes the digital flexion data such as to detect a stop motion of a finger to judge a key-on event according to bending velocity information calculated from the sequentially sampled flexion data, thereby generating musical tones. Further, the controller 4 detects a maximum angle according to the flexion data of the finger restored from the key-on state so as to judge a key-off event according to an off-threshold level correlated to the maximum bend depth to thereby erase musical tones.

14 Claims, 23 Drawing Sheets

Left hand glove

Right hand glove

OSHT Octave shift table

Input Output

| L5 | L3 | OS |
|---|---|---|
| 0 | 0 | 5 |
| 0 | 1 | 6 |
| 1 | 0 | 4 |
| 1 | 1 | 7 |

FIG.28

FNT (Finger note tablle)

| L(1) \ k | 1 thumb | 2 forefinger | 3 middle finger | 4 third finger | 5 little finger |
|---|---|---|---|---|---|
| FNO(k) (L(1)=0) | 0 (C) | 2 (D) | 4 (E) | 5 (F) | 7 (G) |
| FN1(k) (L(1)=1) | 5 (F) | 7 (G) | 9 (A) | 11 (B) | 12 (C) |

right hand input

MUSICAL TONE CONTROL DEVICE WITH PERFORMING GLOVE

BACKGROUND OF THE INVENTION

The present invention relates to a musical tone control device for detecting flexional movements of fingers to control generation of the musical tones according to the detected results.

Conventionally, Japanese patent application Laid-open No. 210895/1988 discloses a musical tone control device of the type operative to directly detect movements of fingers for controlling generation of musical tones without utilizing a keyboard. This musical tone control device utilizes a plurality of finger switches attached to respective fingers and operable to turn on and off selectively according to flexional movements of the individual fingers. The control device operates according to ON/OFF information fed from the finger switches to control various factors of the musical tone signal to be generated. The finger switch is constructed to turn on and off when the flexional amount of the finger crosses a predetermined threshold level.

When playing a piano, the player senses at his finger tips a reaction resistance caused as the depressed key is stopped or a touch feeling at depression of keys to thereby keep a tempo or rhythm. In general, touch feeling of the finger tips is a significant factor for regulating tone generation timings in performance of manually operable musical instruments. However, in the above mentioned musical tone control device of the type utilizing finger switches to directly detect flexional movements of the fingers so as to generate musical tones, it is rather difficult for the performer to adopt the mechanical relation between the physical bend degree of the finger and the threshold level effective to determine ON/OFF of the finger switch. Moreover, the finger switch is turned on and off monotonously according to a fixed bend amount regardless of fingering manner and flexion velocity associated to peculiarity and tactics of an individual performer. Therefore, sounding and silencing timings of musical tones do not practically synchronize with an actual fingering operation of the performer. Even worse, there may be caused inadvertent tone generation. Thus, the conventional control device has drawbacks that it is difficult to handle or adopt.

SUMMARY OF THE INVENTION

An object of the invention is to practically synchronize the control of musical tones with the physical movements of fingers to sophisticate the specific musical tone control device of the type for controlling generation and erase of musical tones according to the flexional movements of fingers.

In one aspect of the present invention, the musical tone control device is constructed such that flexional amounts of fingers are sampled sequentially, and key-on/key-off events are judged based on the sampled flexional amounts so as to generate a tone in response to the key-on event and to erase a tone in response to the key-off event. The inventive device features velocity detecting means for detecting a forward flexion velocity of the finger according to the sequentially sampled flexion amounts, and stop detecting means operative based on the flexion velocity information detected by the velocity detecting means for detecting a stop motion of the finger, in order to judge a key-on event based on the detection of the stop motion.

In another aspect of the present invention, the musical tone control device features maximum depth detecting means for detecting a maximum bend depth or bend angle of a finger which is mined to a key-on state, off-threshold setting means for setting an off-threshold level which is determined shallower or smaller than the detected maximum bend depth or bend angle and which is correlated to the detected maximum bend angle, and key-off judging means for judging a key-off event of the finger according to a restoring flexion amount of the finger from the key-on state in reference to the thus set off-threshold level.

When using the inventive musical tone control device in practical performance of a musical composition, the device can well manage tone generation and tone erase in practically responding manner to the physical finger movements of the performer. For this purpose, the device is constructed to synchronize timings of the tone generation and tone erase according to variable factors dependent on the finger movements as well as according to fixed factors preset in the device. Namely, according to said one aspect of the invention, the stop motion of the finger is detected according to the forward bending velocity of the finger. The key-on event is judged upon detection of the stop motion so as to generate a musical tone. Thus, the tone generation timing practically matches with the physical fingering of the performer. According to said another aspect of the invention, the maximum bend angle is monitored for the finger which is turned to the key-on state, while an off-threshold level is set smaller than the monitored maximum bend angle in correlation thereto. The key-off event of that finger is judged when the restoring reverse amount of that finger from the key-on state crosses the off-threshold level so as to erase the generated tone. Therefore, even if the finger is reversely restored from a deeply bent position, the key-off event of that finger can be timely judged to thereby match the erase timing with the physical stretching movement of the finger.

BRIEF DESCRIPTION OF THE DRAWINGS

FIG. 28 is a diagram showing a finger note table; and

DETAILED DESCRIPTION OF THE INVENTION

Figure 1:
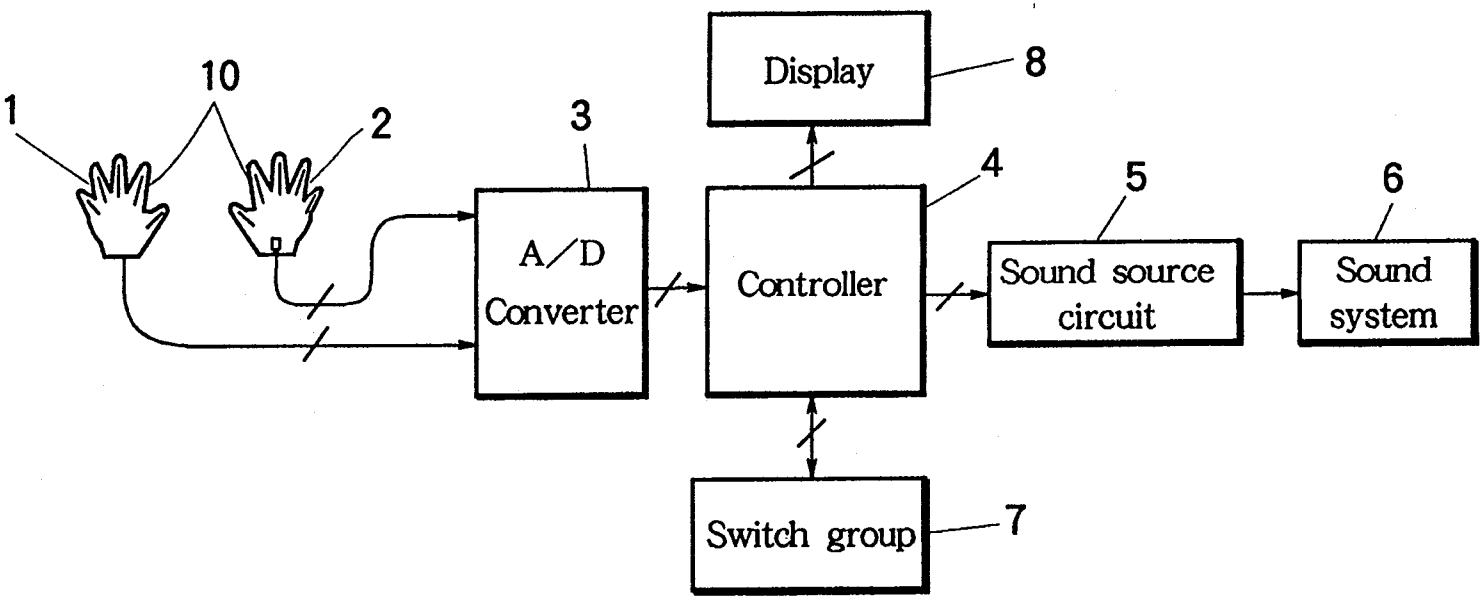
FIG. 1 is a block diagram of an electronic musical instrument equipped with an embodiment of the inventive musical tone control device.

FIG. 1 is a block diagram of the electronic musical instrument equipped with an embodiment of the inventive musical tone control device. This electronic musical instrument is provided with a pair of performing gloves 1 and 2 provided with bend sensors 10 for detecting flexion amounts or bend angles of respective fingers of a performer. The performer wears the gloves 1, 2 and manipulates fingers as if playing a piano, so that key-on/key-off event is detected in response to flexional movements of the right and left fingers to generate musical tones according to the key-on/key-off states of the respective fingers.

Figure 2A:
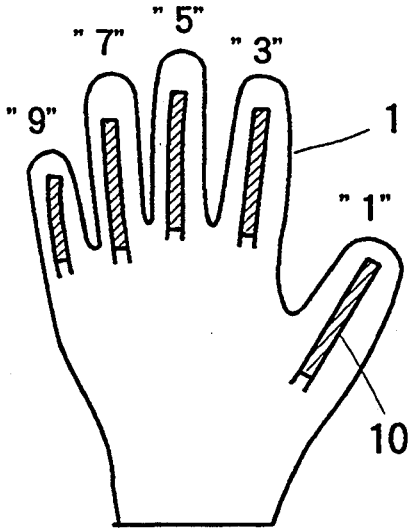
FIG. 2 is a schematic view of performing gloves used in the embodiment.
Figure 2B:
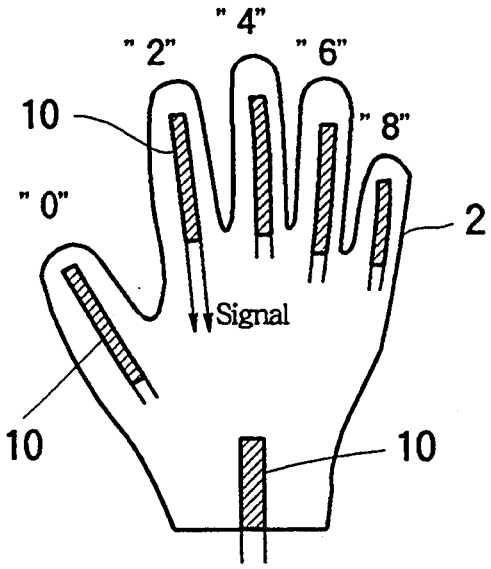
Figure 3:
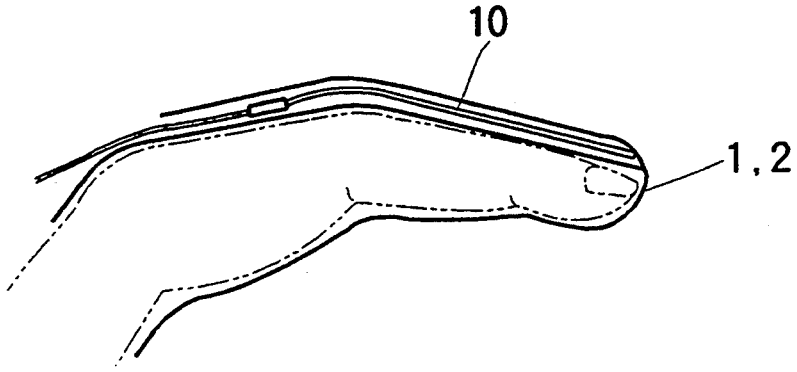
FIG. 3 is a partial sectional view of a sack portion of the performing glove.

FIG. 2 shows overall construction of the performing gloves 1, 2 and FIG. 3 shows a section of a sack portion thereof. These performing gloves 1, 2 have a thin and elongated space which contains therein the bend sensor 10 along a back of each finger fitted in the sack portion.

Figure 4:
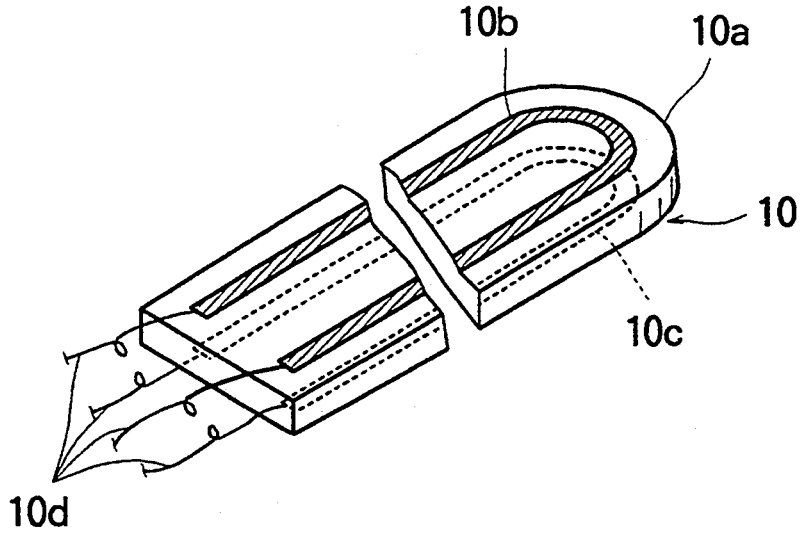
FIG. 4 is a perspective view of a bend sensor provided in the performing glove.

FIG. 4 shows a detail structure of one bend sensor 10. This sensor 10 is similar to an angle detector disclosed in Japanese patent application No. 83704/1990, and is comprised of a pair of resistive elements 10*b* and 10*c* of the U-shape disposed on front and rear faces of a substrate 10*a* composed of flexible plastic material. The resistive elements 10*b*, 10*c* are deflected in response to a flexional movement of each finger to thereby vary their resistance values. The resistance variation is detected through lead wires 10*d* in the form of a voltage signal. The voltage signal is processed to detect key-on/key-off event of each finger according to the flexion amount.

Referring back to FIG. 2, an additional bend sensor 10 is disposed at a wrist portion of the right performing glove 2 in this embodiment so as to detect a flexion amount of the right wrist to switch conditions to determine the key-on event when a right finger is bent.

In this embodiment, the thumb, forefinger, middle finger, third finger and little finger of the left performing glove are indexed by odd digit numbers "1", "3","5", "7", and "9", respectively. With regard to the right performing glove, the thumb, forefinger, middle finger, third finger and little finger are indexed by even digit numbers "0", "2", "4", "6" and "8", respectively. Respective registers and data are discriminated by these digit numbers correspondingly to individual fingers hereinafter in the description of the structure and operation of the inventive device. Further, if desired in the description, individual fingers of the left and right hands are denoted by a combination of a symbol F and digit numbers "0"–"9" such as the right middle finger is denoted by F4.

Referring back to FIG. 1, an A/D converter 3 is connected to apply a given electric current to the bend sensors 10 of the performing gloves 1 and 2. Then, the performing gloves 1, 2 produce signals in the form of voltages according to the resistance values of the respective bend sensors 10 to represent flexion amounts of the fingers and the right wrist. These signals are converted into digital data by the A/D converter 3, and then are sequentially inputted into and sampled by a controller 4. This controller 4 operates according to the digital data fed from the A/D converter 3 and representative of the flexion amounts (hereinafter the digital data are referred to as "flexion data") so as to produce those of a key code indicative of a pitch of a musical tone to be generated, a note-on signal to effect tone sounding, a note-off signal to effect tone silencing, and a velocity signal indicative of an initial touch. A sound source circuit 5 is connected to the controller 4 to form tone signals based on these signals fed from the controller 4. A sound system 6 operates according to the tone signals to generate musical sounds. In addition, the controller 4 is connected to a group of switches 7 operable to set tone colors and various functions, and to a display 8 which displays various setting statuses. These A/D converter 3, controller 4, switch group 7 and display 8 are mounted on a belt (not shown in the figure) which is attached around the waist of the performer.

Figure 5:
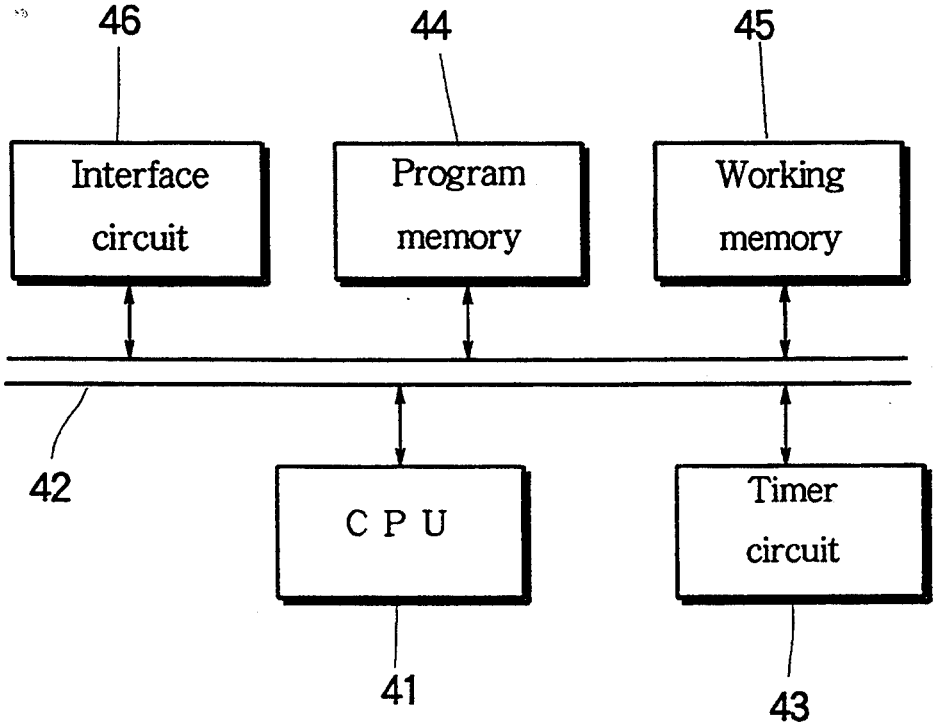
FIG. 5 is a block diagram of a controller provided in the embodiment.

FIG. 5 is a block diagram of the controller 4. The controller 4 is comprised of, for example, a microcomputer including a CPU 41 which is connected through a bidirectional bus line 42 to those of a timer circuit 43, a program memory (ROM) 44, a working memory (RAM) 45, and a interface circuit 46 having various ports. The flexion data are sequentially sampled by the CPU 41 from the A/D converter 3 through the interface circuit 46. The program memory 44 stores therein control programs shown in flowcharts of FIGS. 6–23. The CPU 41 operates based on these control programs with using various registers and flags set in the working memory 45, and constants and tables stored in the program memory 44. Further, the timer circuit 43 of this embodiment generates an interruption signal every 8 msec so that the CPU 41 carries out sampling operation of the flexion data with respect to each finger and the right wrist every 8 msec in response to the interruption signal.

Next, the description is given for various functions which are assigned to respective fingers of the performing gloves 1, 2 and which are determined by the flexional attitudes thereof. The right fingers F0, F2, F4, F6 and F8 are assigned selectively with either two groups of 5-degree scale of note names C, D, E, F and G, or note names F, G, A, B and C. These two scale groups are switched according to bent and stretched states (ON and OFF states) of the left thumb (F1). Further, the octave of the notes is determined according to the combination of the ON and OFF states of the fingers F3 and F5. Moreover, the tone pitch designated by the right hand finger is raised by one half tone in response to the ON action of the finger F7, and is otherwise lowered by one half tone in response to the ON action of the finger F9. In case that the two fingers F7 and F9 are simultaneously turned to the ON state, there can be effected different functions of a priority mode and a trill mode, which are provisionally set by the switch group 7. The priority mode is such that one of the fingers F7 and F9 is given the priority when both are turned to the ON state. This mode is prepared for a handicapped performer which cannot flex the adjacent pair of little and third fingers independently from one another. The particular finger given with the priority is designated provisionally by the operation of the switch group 7. The set states of # by the finger F7 and the other set state of b by the finger F9 are written in a register SS which will be described later in detail. On the other hand, the trill mode is such that a tone pitch group of continuous half tones are added to tone pitches of whole tones designated by the right fingers when both of the fingers F7 and F9 are turned on to effect trill performance.

The list is given hereinbelow for major members of the registers, flags and tables utilized in this embodiment.

MULTIPLE UNIT REGISTERS new(i): storing current flexion data of the respective fingers spd(i): storing maximum values of differential flexion data (velocity data) of the respective fingers ssp(i): storing start-threshold values of flexion data used to detect start motion of the respective fingers s64(i): storing differential flexion data of the respective fingers each 64 msec time slot s16(i): storing differential flexion data of the respective fingers each 16 msec time slot

SINGLE UNIT REGISTERS wrt: storing a current flexion datum of the left hand wrist owrt: storing an old flexion datum of the left hand wrist, detected before eight sampling times offf: storing a maximum value of bend angles of the right fingers in the key-on state TC: storing a number of sampled flexion data of the fingers and wrist in a data buffer onn: storing a digit number of a particular finger associated to a currently generated tone max: storing a digit number of a particular finger designated for a candidate of a next note-on operation buf: reserving a datum on processing OS: storing an octave shift datum ND: storing a note code KCD :storing a key code

MULTIPLE UNIT FLAGS

ST(i): state flags indicating key-on/key-off state of the respective fingers

EV(i): event flags indicating key-on/key-off event of the respective fingers

MST(i): motion state flags indicating stop/start motion state of the respective fingers MEV(i): motion event flags indicating motion event of the respective fingers

TABLES

FD(p, q): recording a function value associated to a bend angle of an adjacent finger of the left hand FP(r): recording a parameter set according to a combination of adjacent left fingers and a relative bend degree difference therebetween VCT1(x): recording a velocity curve table value in terms of a bend angle of a finger VCT2(y): recording a velocity curve table value in terms of a bend speed of a finger FN0(k), FN1(k): recording finger note table values Hereafter in the descriptions and the associated flowcharts, the respective registers, flags and tables are denoted by the above listed labels, and their contents are also denoted by the same labels unless otherwise specified.

Next, the description is given for outlines of the control program including main routine, interrupting routine and various subroutines in conjunction with the flowcharts of FIGS. 6–23.

MAIN ROUTINE

Figure 8:
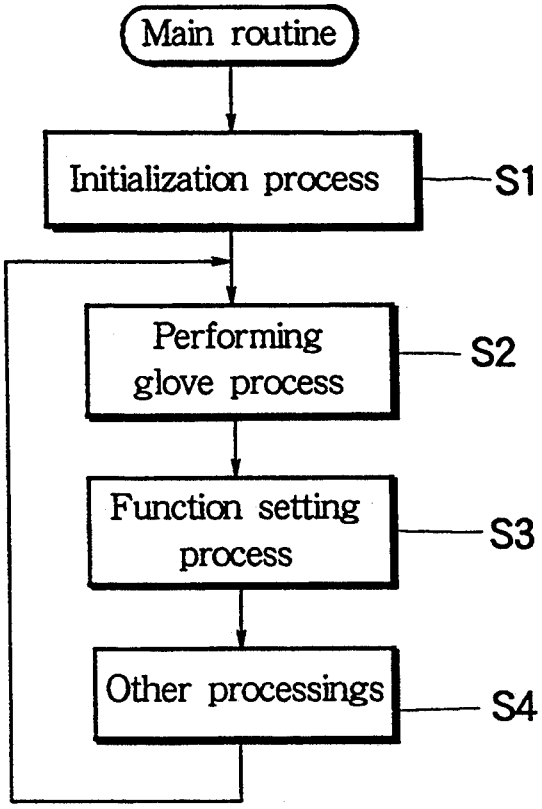
FIG. 8 is a flowchart showing a main routine executed in the embodiment.

Referring to FIG. 8, when the controller 4 is powered, the CPU 41 starts the processing of the main routine to carry out initialization such as set-up of the respective registers in Step S1. Then, the CPU 41 repeatedly executes a performing glove process of Step S2, a function setting process of Step S3 and other processings of Step S4. In Step S3, the function setting process is carried out such as to switch tone colors according to operation of the switch group 7. The other processings of Step 4 include status indication on the display 8.

INTERRUPTING ROUTINE

Figure 9:
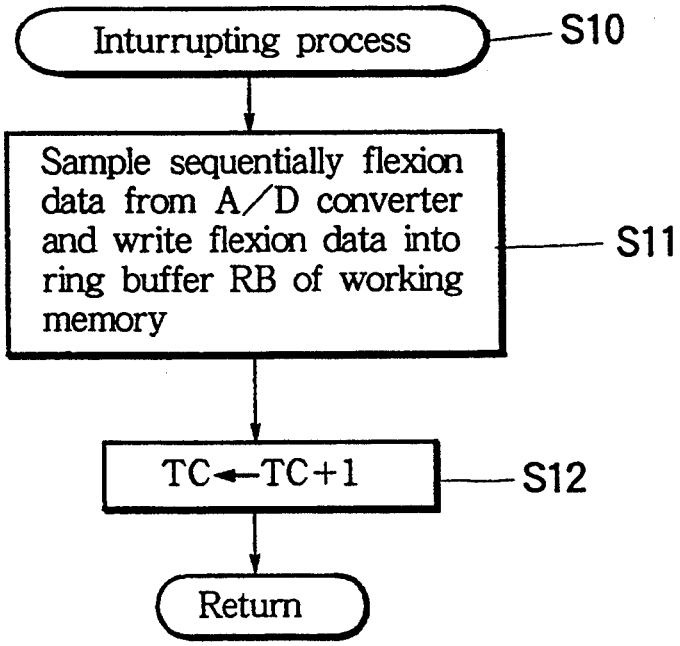
FIG. 9 is a flowchart showing an interruption process executed in the embodiment.
Figure 24:
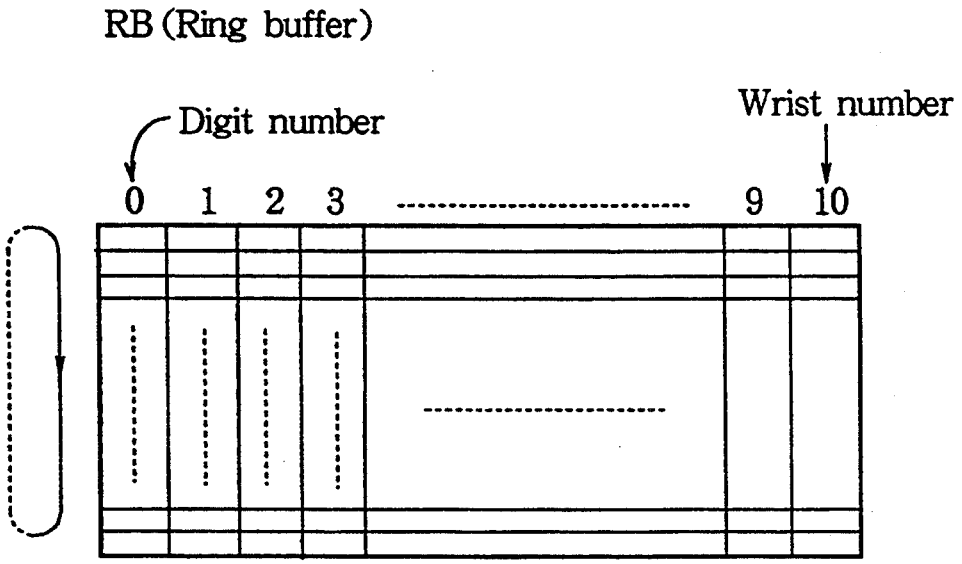
FIG. 24 is a schematic diagram showing a ring buffer utilized in the embodiment.

Referring to FIG. 9, interrupting process S10 is called every 8 msec in response to the interruption signal from the timer circuit. The flexion data of the respective fingers and the right wrist are sequentially retrieved from the A/D converter 3, and they are written into a ring buffer RB within the working memory 45 in Step S11. The time counter TC is incremented at Step S12, thereby returning. As shown schematically in FIG. 24, the ring buffer RB is comprised of multiple number (eleven in this embodiment) of cyclic shift register units discriminated by the digit numbers (0–9) of the fingers and the wrist number (10) of the right hand. The controller 4 designates the respective digit numbers and the wrist number, and updates writing addresses cyclicly as indicated by the arrow to record sequentially the flexion data of the fingers and the right wrist every 8 msec.

PERFORMING GLOVE PROCESSING ROUTINE

Figure 10:
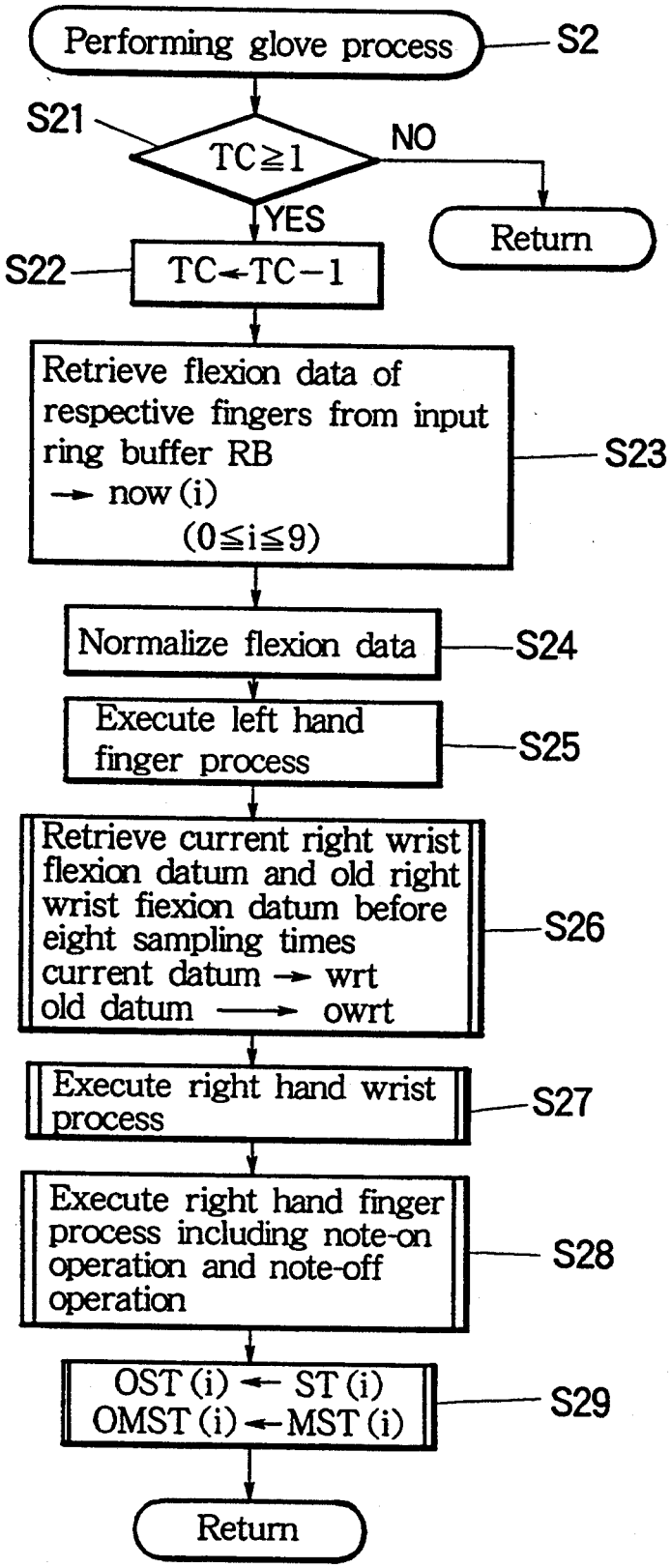
FIG. 10 is a flowchart showing a performing glove process executed in the embodiment.

In this preforming glove process S2 shown in FIG. 10, first check is made at Step S21 as to whether the time counter TC is set with "1" or more. If not, the judgment is held that the ring buffer RB is not recorded with new flexion data to thereby return to the main routine. On the other hand, if the time counter TC indicates "1" or more, the time counter TC is decremented at Step S22. Then, the flexion data designated by the respective digit numbers (i=0–9) are retrieved from the input ring buffer RB, and they are stored in a register now(i) in Step S23. The stored flexion data are subjected to normalization process in Step S24. In this normalization process, the following formula is computed with respect to each digit number (i=0–9) based on constants BTM(i) and SLP(i) stored in the program memory 44. The computed results are stored in the register new(i) and in a reserve register hkn(i). The formula is given:

$$\{now(i)-BTM(i)\}\times SLP(i)+BTM(i)$$

where the constant BTM(i) represents a flexion datum of each finger in the most stretched state, and the other constant SLP(i) represents a scaling value of each finger. Dynamic detection range of the flexion data is suitably expanded or contracted by this normalization process. After finishing the normalization process in Step S24, a left hand finger process is executed in Step S25 based on the normalized flexion data new(i) and hkn(i) as described later in detail. After the left hand finger process S25, the flexion datum of the right wrist is retrieved from the ring buffer RB, and it is stored in the register wrt in Step S26. Further in this Step, an old flexion datum eight sampling times (64 msec) prior to the presently retrieved wrist flexion datum is also read out from the ring buffer RB, and is then stored in the register owrt. In subsequent Step S27, a right hand wrist process is carried out based on the stored flexion data wrt and owrt as will be later described in detail. Then, a right hand finger process S28 is carried out such that note-on operation is executed to command tone generation and that note-off operation is executed to command tone erase based on the finger flexion data new(i) as will be described later in detail. Then at Step S29, contents of the state flag ST(i) which indicates whether the respective fingers are held in key-on state are transferred correspondingly to another state flag OST(i), and contents of the motion state flag MST(i) which indicates whether the respective fingers are moving are transferred to another motion state flag OMST(i), thereafter returning to the main routine from this performing glove process S2. Since the time counter TC is incremented everywhen a set of the flexion data are written into the ring buffer RB by the before-mentioned interrupting process S10, the above performing glove process S2 is successively carried out for each set of the flexion data written in the ring buffer.

LEFT HAND FINGER PROCESS OUTLINE

Figure 6:
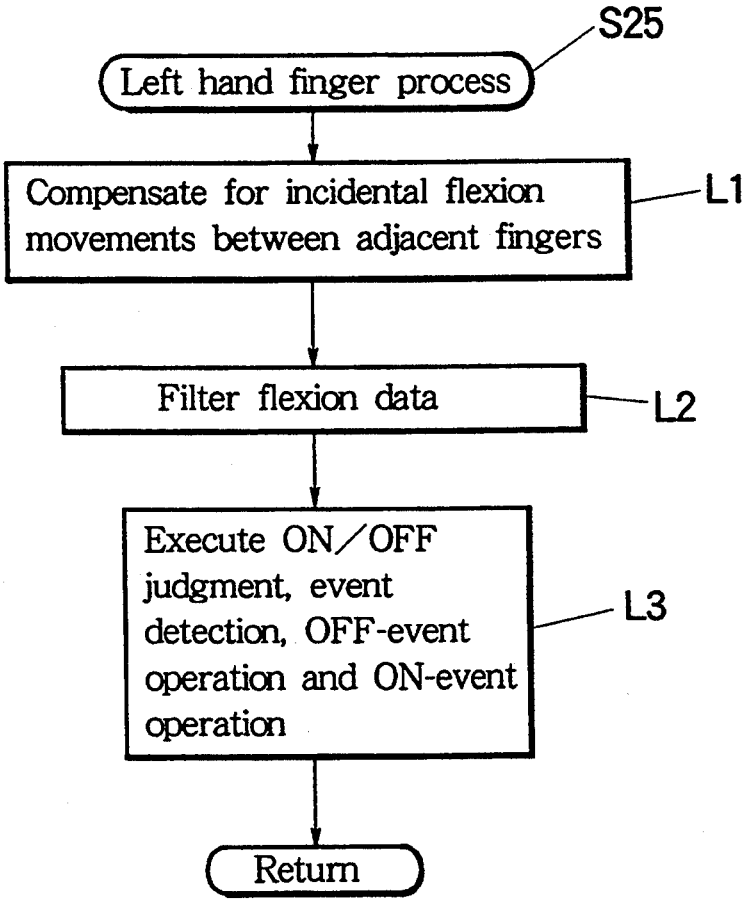
FIG. 6 is a flowchart showing an outline of a left hand finger process executed in the embodiment.

FIG. 6 is a flowchart showing an outline of the left hand finger process S25 which is carried out by Steps L1, L2 and L3. In Step L1, incidental flexion movement compensation is effected in view of the spontaneous nature that one finger tends to flex incidentally to and responsively to flexional movement of another finger between adjacent pairs such as F3/F5, F5/F7 and F7/F9 except for the thumb. The original flexion datum of the spontaneously linked finger or the subordinate finger is compensated according to a parameter set dependently on finger bend angles and another parameter related to the sequence of the finger pairs. In subsequent Step L2, the compensated flexion data are further subjected to filtering operation for dealing with an occasional abrupt variation of the flexion amount. Next processing is carried out based on the flexion data in Step L3, such as judgment of key-on/key-off of the fingers, detection of key-on/key-off event, and OFF-event and ON-event operations upon detection of the key event. The various modes such as a tone pitch range are set by these OFF-event and ON-event operations, so that sounding of a particular tone is initiated correspondingly to a turned-on finger of the right hand and silencing of another tone is effected correspondingly to a turned-off finger of the right hand.

RIGHT HAND FINGER PROCESS OUTLINE

Figure 7:
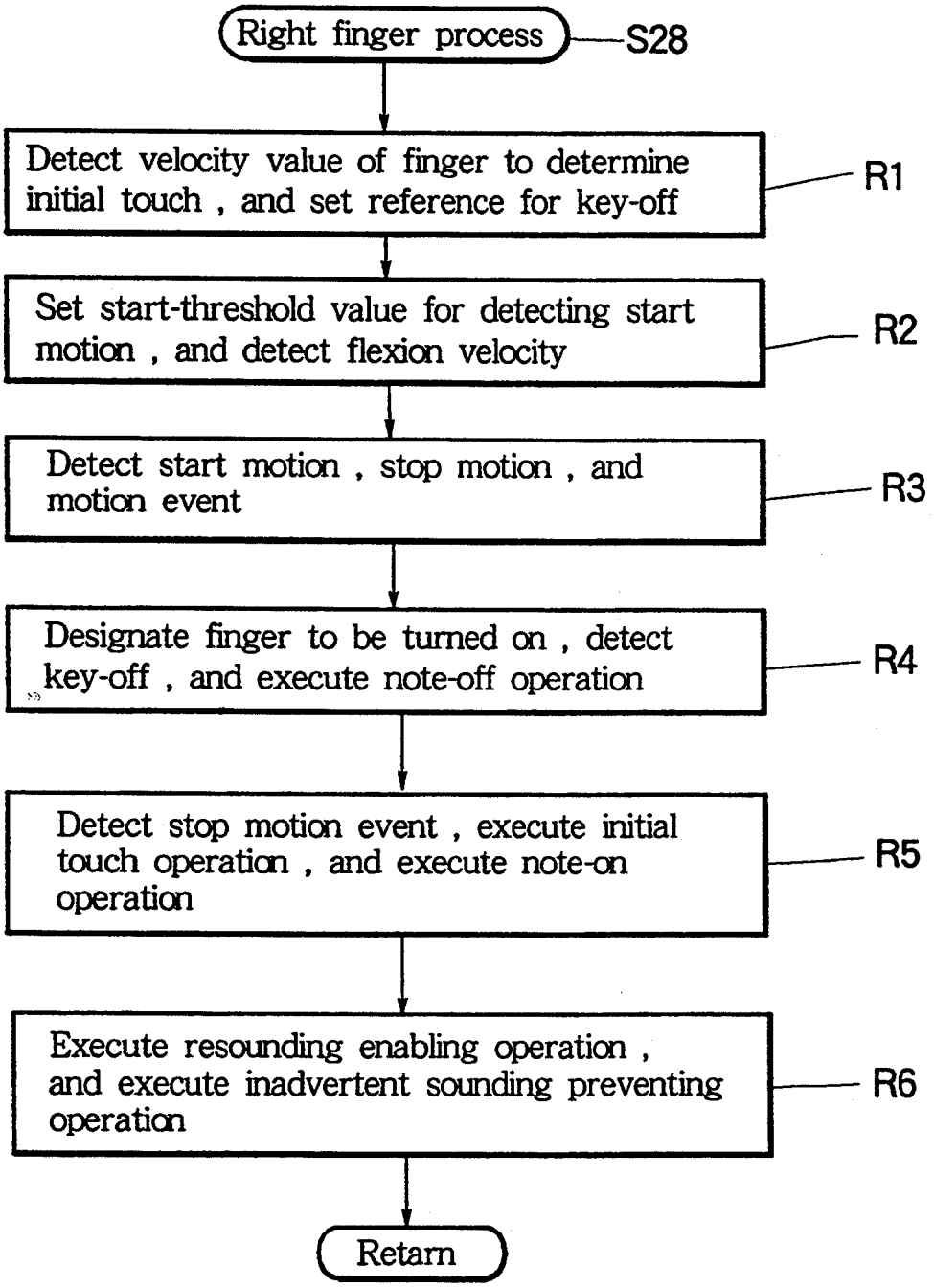
FIG. 7 is a flowchart showing an outline of a right hand finger process.

FIG. 7 is a flowchart showing an outline of the right hand finger process S28 which includes Steps R1–R6 executed sequentially as follows. Firstly, Step R1 is carried out so as to detect a positive speed of a finger movement when the finger is flexed forward in order to obtain a velocity value of an initial touch, and this velocity value, i.e., differential flexion datum is stored in the register spd(i). Further, when a positive variation of a flexion datum is observed with respect to a finger of the key-on state, this current flexion datum is stored in the register offf to update a reference for use in the key-off judgment. By such operation, the effective reference can be set for the key-off judgment according to a forward bend angle of the key-on state finger to thereby avoid delay of the key-off judgment which would otherwise occur when the finger returns from the deeply bent state. Second Step R2 is carried out such that a start-threshold value is calculated according to an initial or stationary bend degree of a rest finger, and the calculated result is stored in the register ssp(i) in order to detect start motion of the rest finger. Further, a differential flexion datum each 64 msec time slot is stored in the register s64 and another differential flexion datum each 16 msec time slot is stored in the register s16, used as velocity information for the detection of stop motion of a moving finger and for the detection of start motion of the rest or stationary finger. Third Step R3 is carried out to effect the start motion detection of the rest finger and the stop motion detection of the moving finger, as well as to detect the event of start/-stop motion. Then the value "0" or "1" is set, respectively, in the motion state flag MST(i) indicative of the motion state and in the motion event flag MEV(i) indicative of the motion event. Fourth Step R4 is carried out to designate a particular finger to be turned on for sounding according to the stop/move state of the right wrist, and a digit number of that designated finger is stored in the register max. Further, judgment operation as to key-off and note-off operation are carried out according to the content of the register offf. Fifth Step R5 is carried out to effect a stop motion event detection operation with regard to the particular finger registered by the register max, an initial touch operation effective to determine the flexion velocity value of the particular finger, and a note-on operation. The last Step R6 is carried out to effect operation of enabling resounding of the turned-on finger and operation of avoiding inadvertent tone generation due to swing of the wrist and fluctuation of the fingers. In this right hand finger process S28, Step R1 is effective to avoid timing delay of the key-off judgment, and Steps R2, R3 are effective to control tone generation by the specific stop motion detection, thereby enabling musical sound generation in synchronization with the performance action.

Hereinafter, the detailed description will be given for the left hand finger process S25, the right hand wrist process S27 and the right hand finger process S28 in conjunction with FIGS. 11–23.

LEFT HAND FINGER PROCESS DETAIL

Figure 11:
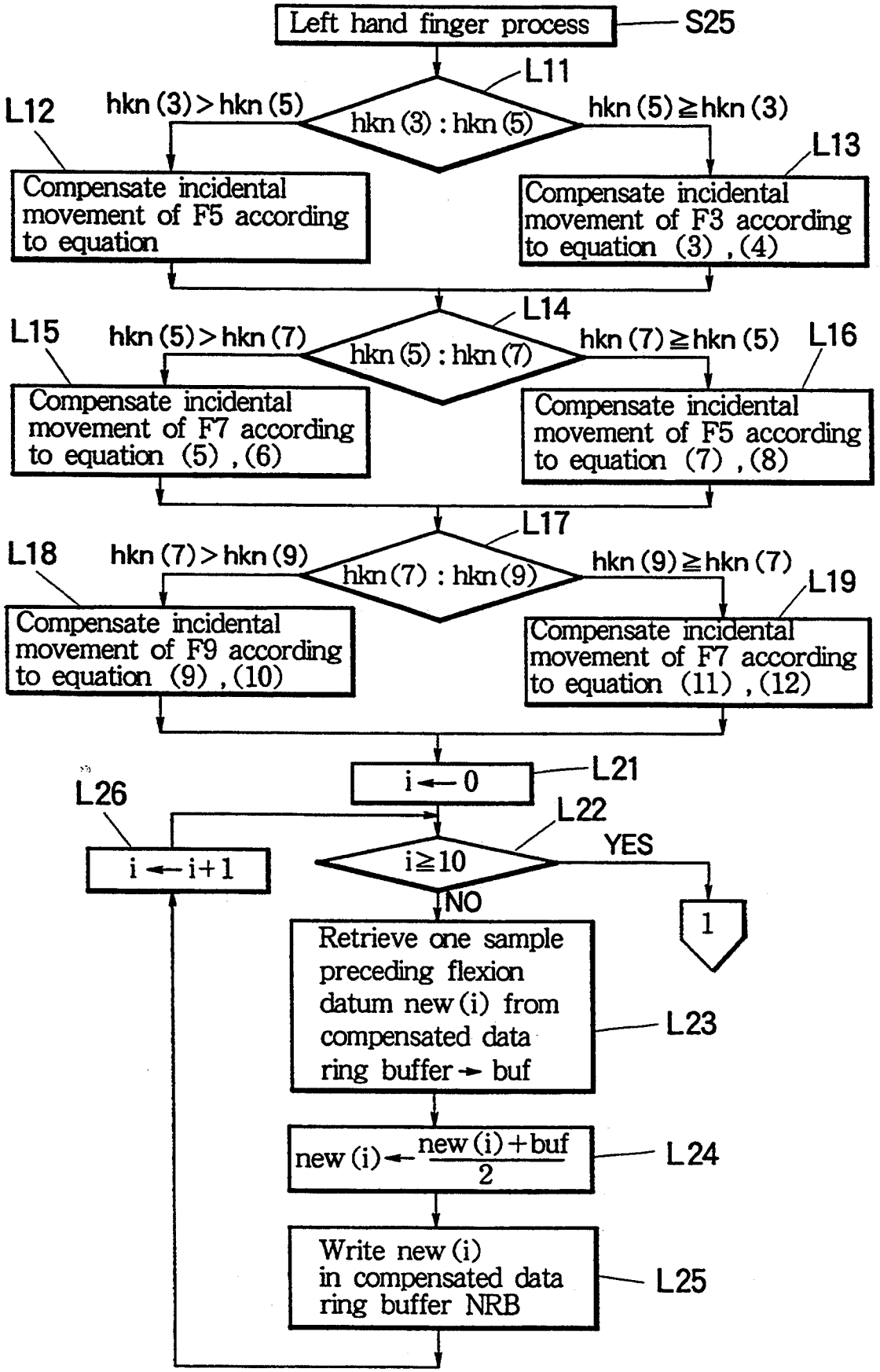
FIG. 11 is a flowchart showing a detail part of the left hand finger process.
Figure 12:
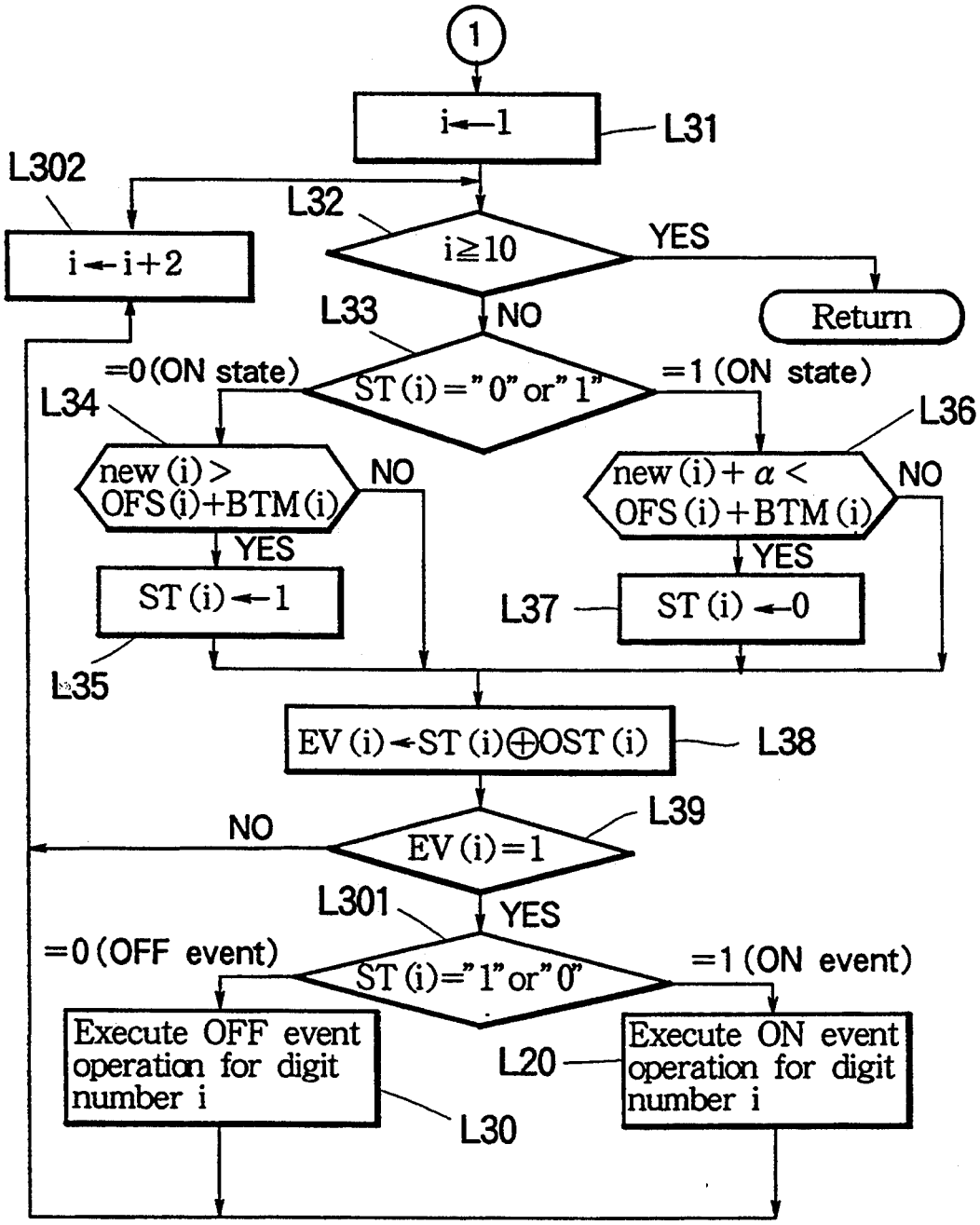
FIG. 12 is a flowchart showing another detail part of the left hand finger process.

FIGS. 11 and 12 are a flowchart showing the detail of the left hand finger process S25. In this process S25, Step L11 is executed to compare the flexion datum hkn(3) of the index finger F3 and the flexion datum hkn(5) of the adjacent middle finger F5 with each other. Then, one of Steps L12 and L13 is selectively carried out according to the comparison result to effect the compensation for incidental movements in the adjacent pair of F3 and F5 by calculating the following equations (1), (2) in case of Step L12 or the following equations (3), (4) in case of Step L13. In similar manner, Steps L14, L15 and L16 are carried out to effect compensation for incidental movements of the adjacent fingers F5 and F7 according to the following equations (5)–(8). Further, Steps L17, L18 and L19 are carried out to effect compensation for incidental movements of the adjacent fingers F7 and F9 according to the following equations (9)–(12).

In case of hkn(3)>hkn(5)

$$hbuf=(hkn(3)-hkn(5))\times FD(hkn(5),\ hkn(3)) \quad (1)$$

$$new(5)=hkn(5)-hbuf\times FP(0) \quad (2)$$

In case of hkn(5)≧hkn(3)

$$hbuf=(hkn(5)-hkn(3))\times FD(hkn(3),\ hkn(5)) \quad (3)$$

$$new(3)=hkn(3)-hbuf\times FP(1) \quad (4)$$

In case of hkn(5)>hkn(7)

$$hbuf=(hkn(5)-hkn(7))\times FD(hkn(7),\ hkn(5)) \quad (5)$$

$$new(7)=hkn(7)-hbuf\times FP(2) \quad (6)$$

In case of hkn(7)≧hkn(5)

$$hbuf=(hkn(7)-hkn(5))\times FD(hkn(5),\ hkn(7)) \quad (7)$$

$$new(5)=hkn(5)\times hbuf\times FP(3) \quad (8)$$

In case of hkn(7)>hkn(9)

$$hbuf=(hkn(7)-hkn(9))\times FD(hkn(9),\ hkn(7)) \quad (9)$$

$$new(9)=hkn(9)-hbuf\times FP(4) \quad (10)$$

In case of hkn(9)≧hkn(7)

$$hbuf=(hkn(9)-hkn(7))\times FD(hkn(7),\ hkn(9)) \quad (11)$$

$$new(7)=hkn(7)-hbuf\times FP(5) \quad (12)$$

In the above listed equations, FD(hkn(i+2), hkn(i)) and FD(hkn(i), hkn(i+2)) are function values in terms of flexion data (bend angles) of an adjacent pair F3/F5, F5/F7 or F7/F9. FP(j) is a parameter which is set according to the quantitative relation of the flexion data between the adjacent fingers of each pair. These function value FD and parameter FP are stored as table data in the program memory.

The above described computation is executed effectively for the incidental movement compensation in manner similar to the art disclosed in Japanese patent application Laid-open No. 304489/1990. The flexion datum of a subordinate finger of relatively shallow attitude is compensated according to the bend degree difference from the other dominant finger of relatively deep attitude and according to a sequence of the adjacent pair of the fingers. This compensation scheme is based on the facts that when one finger is bent relatively shallowly, another adjacent finger is not so strongly affected by movement of the one finger, and that when one finger is bent deeply, another adjacent finger tends to flex heavily due to the movement of the one finger. Thus, the original flexion datum is compensated properly according to the bend degree of an adjacent finger. Further in this embodiment, the bend degree difference is multiplied by the function value FD to adjust the compensation amount according to the bend amount. This function value FD is set to a smaller value when a subordinate finger is bent deeper while a dominant finger is flexed to a certain bend degree. Namely, when the subordinate finger is bent deeply, the compensation amount is reduced to accurately compensate the flexion datum of the subordinate finger to thereby reflect an actual incidental movement effect.

After the incidental movement compensation, the digit number i is reset to "0" in Step L21. Then, checking Step L22 and incrementing Step L26 of the digit number i are sequentially carried out to undertake repeatedly a loop process of Steps L23–L25 so as to effect filtering operation of the flexion datum new(i) for the respective right and left fingers. In this operation, the filtered flexion data are sequentially written into the compensated data ring buffer NRB. This compensated data ring buffer NRB is provided in the working memory 45 in manner similar to the input ring buffer RB which records the initial flexion data by the interrupting process S10.

Firstly in Step L23, an immediately preceding flexion datum after subjected to the incidental movement compensation is retrieved from the compensated data ring buffer NRB, and is then leaded into the register buf. Then in Step L24, the sum of the present flexion datum new(i) and the preceding flexion datum buf is half-divided to calculate a filtered or leveled flexion datum. Lastly in Step L25, the present flexion datum new(i) is replaced by this filtered flexion datum in the compensated data ting buffer NRB. This filtering operation is carried out for every flexion datum new(i) of the left and right fingers, thereby proceeding to a next process.

Referring next to FIG. 12, the digit number i is set to "1" in Step L31. Then, checking Step L32 and incrementing Step L302 of incrementing the digit number i by "2" are sequentially carried out to execute a loop operation of Step L33 and following steps repeatedly for each of the left fingers. Firstly in Step L33, the state flag ST(i) is read to check as to the current state of each finger. If the ST(i) indicates "0" which represents the OFF state, the processing advances to Step L34 where check is made as to whether the current flexion datum new(i) stored in the compensated data ting buffer NRB exceeds a given threshold value which is determined correspondingly to respective one of the left fingers. If the flexion datum new(i) exceeds the threshold value, Step L35 is executed to set the state flag ST(i) to "1". If the flexion datum does not exceeds the threshold value, the process advances to Step L38.

On the other hand, if the check at Step L33 proves ST(i)="1" which represents the On state, Step L36 is undertaken to check as to whether the current flexion datum new(i) added with a given hysterisis value $\alpha$ becomes lower than the threshold value. If the check is affirmative, Step L37 is undertaken to reset the state flag ST(i) to "0". On the other hand, if the check is negative, the process proceeds to Step L38. In these operations, the threshold value used in Steps L34, L36 is given by the sum of the constant datum BTM(i) which represents the most stretched degree of the finger and the offset value OFS(i). When the finger is bent forward over this threshold value, a key-on event occurs. When the finger is stretched reversely or restored by the hysterisis amount $\alpha$ from the threshold value, a key-off event occurs.

After updating the key-on/key-off state, subsequent Step L38 is undertaken for the event detection. Namely, exclusive logical OR operation is taken between the old state flag OST(i) set by the main routine and the current state flag ST(i), and the results of this logical operation are stored in the event flag EV(i). Then, Step L39 is undertaken to check as to whether EV(i)="1". If EV(i)≠"1" is held, the process advances to Step L302. If EV(i)="1" is held, Step L301 is undertaken to check as to whether the state flag ST(i)="1" or "0". If the state flag ST(i)="1" is held, the key-on or ON event is detected so that the ON event operation is carried out in Step L20. If the state flag ST(i)="0" is held, the key-off or OFF event is detected so that the OFF event operation is executed in step L30. After completing the judgment of the key-on/key-off event and the operation of the ON event/OFF event, the process returns to the performing glove process routine. Step L20 of the ON event operation and Step L30 of the OFF event operation will be described later in detail.

RIGHT HAND WRIST PROCESS DETAIL.

Figure 13:
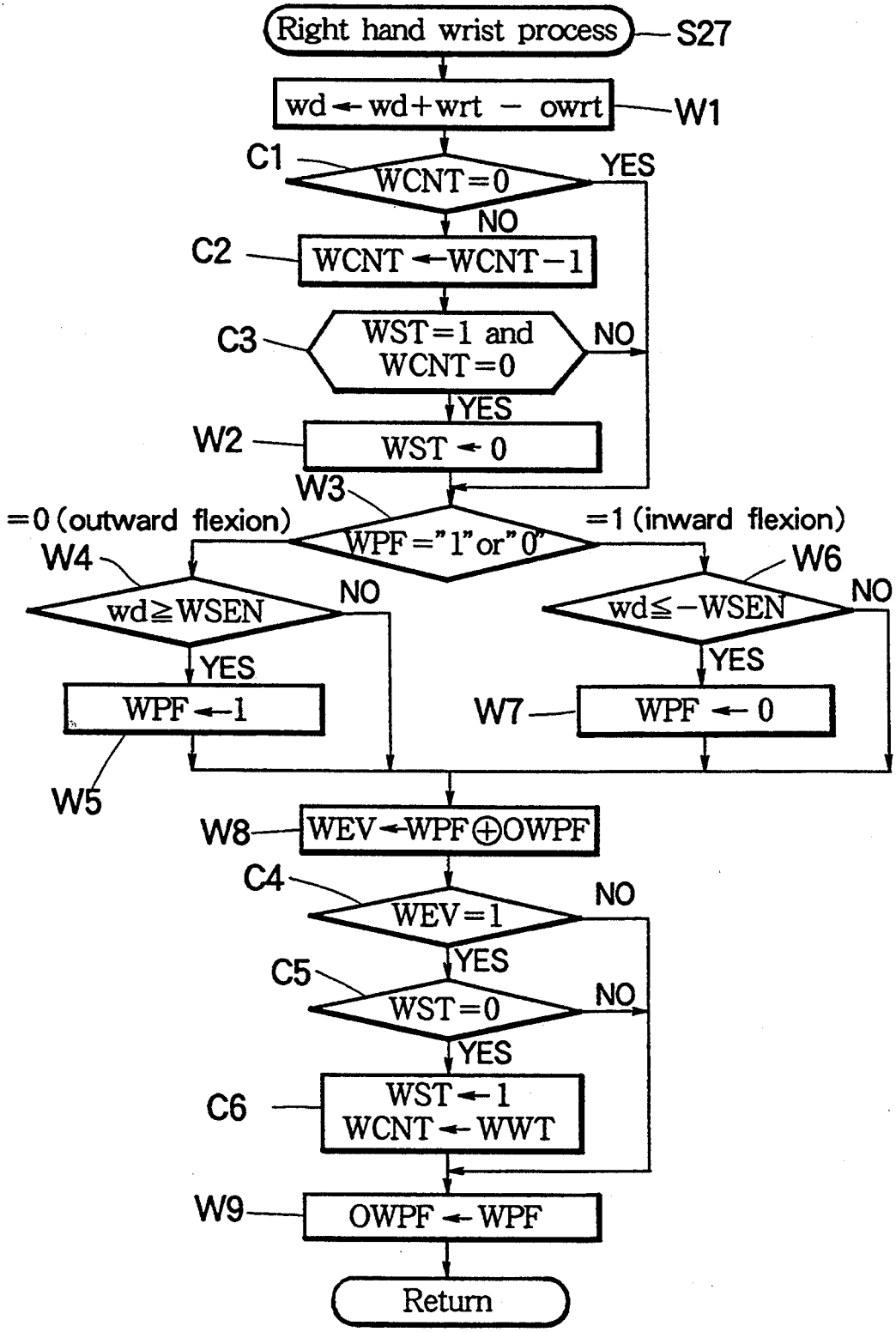
FIG. 13 is a flowchart showing a right hand wrist process.

FIG. 13 is a flowchart showing the subroutine of the right hand wrist process S27. In this process, Steps C1, C2 and C3 are executed to carry out countdown of a counter WCNT, and Steps C4, C5 and C6 are conducted to carry out setting of a counter value WWT. Meanwhile, it is detected whether the wrist is flexed inwardly in a positive direction or outwardly in a negative direction by a given amount. Further, a wrist state flag WPF is set to indicate either of states that the wrist is flexed in the positive direction over the given amount and that the wrist is flexed in the negative direction over the given amount, thereby detecting the flexional movement of the left wrist. In response to the detection of the wrist flexion, the counter WCNT is counted down to set a flag WST to "1" for a given time interval. After lapse of the interval, the flag WST is reset to "0". In addition, when starting the right hand wrist process, the register wrt is set with the current wrist flexion datum and the other register owrt is set with the old wrt flexion datum before eight sampling times.

Firstly in Step W1, a content of a register wd is added with the new flexion datum of the register wrt and is subtracted by the old flexion datum of the register owrt. The calculated result is returned to the register wd. By such operation of Step W1, the register wd is updated everytime the right hand wrist process S27 is called so that the register wd contains the total value of eight consecutive samples of the flexion data from the newest one to the older eighth one. The wrist flexion is detected based on this total value wd of the flexion sample data. In subsequent Step C1, check is made as to if the counter value WCNT="0". If WCNT="0" is held, the processing jumps to Step W3. On the other hand, if WCNT≠"0" is held, Step C2 is undertaken to decrement the counter value WCNT. Then, Step C3 is carried out to check as to whether the flag WST="1" and the counter value WCNT="0". If this condition is not satisfied in Step C3, the processing advances straightforward to Step W3. On the other hand, when the condition is satisfied, the flag WST is reset to "0" in Step W2, thereafter proceeding to the Step W3.

Subsequent Step W3 is carried out to check as to whether the flag WPF is set with "1" or "0". If WPH="0", Step W4 is undertaken to check as to if the total value wd of eight consecutive sample data exceeds or is equal to a given positive threshold value WSEN. If it is held that wd is lower than WSEN, the processing advances to Step W8. On the other hand, wd≧WSEN is held, the flag WPF is set to "1" in Step W5, thereby proceeding to Step W8. In turn, when the flag WPF="1" is held in Step W3, Step W6 is selected to check as to if the total value wd of eight consecutive sample data is smaller than a given negative threshold value-WSEN. If wd>-WSEN is found, the processing advances to Step W8. On the other hand, if wd≦-WSEN is held, the flag WPF is reset to "0" in Step W7, thereby proceeding to Step W8.

Next, event detection is effected in Step W8. Namely, exclusive logical OR operation is taken between the present flag WPF and the old flag OWPF which has been set in the previous wrist process cycle, and the result is set in the event flag WEV. Thereafter, Step C4 is undertaken to check as to whether the event flag WEV="1". If WEV="1" is not held, the processing advances to Step W9. On the other hand, if WEV="1" is held, Step C5 is taken to check as to whether the flag WST="0". When the flag WST="1" is found in Step C5, the processing advances to Step W9. On the other hand, when the flag WST="0" is held, Step C6 is carried out to set the flag WST to "1" and to set a given value WWT to the counter WCNT, thereafter proceeding to Step W9. The present flag WPF is replaced to the old flag OWPF in Step W9, thereby returning to the performing glove process routine. As described above, this right hand wrist process is effected such that the flag WST is kept "1" for a given duration upon detection of the wrist flexion. The right hand finger process is selectively changed according to whether the flag WST is set with "1" or "0".

Figure 29:
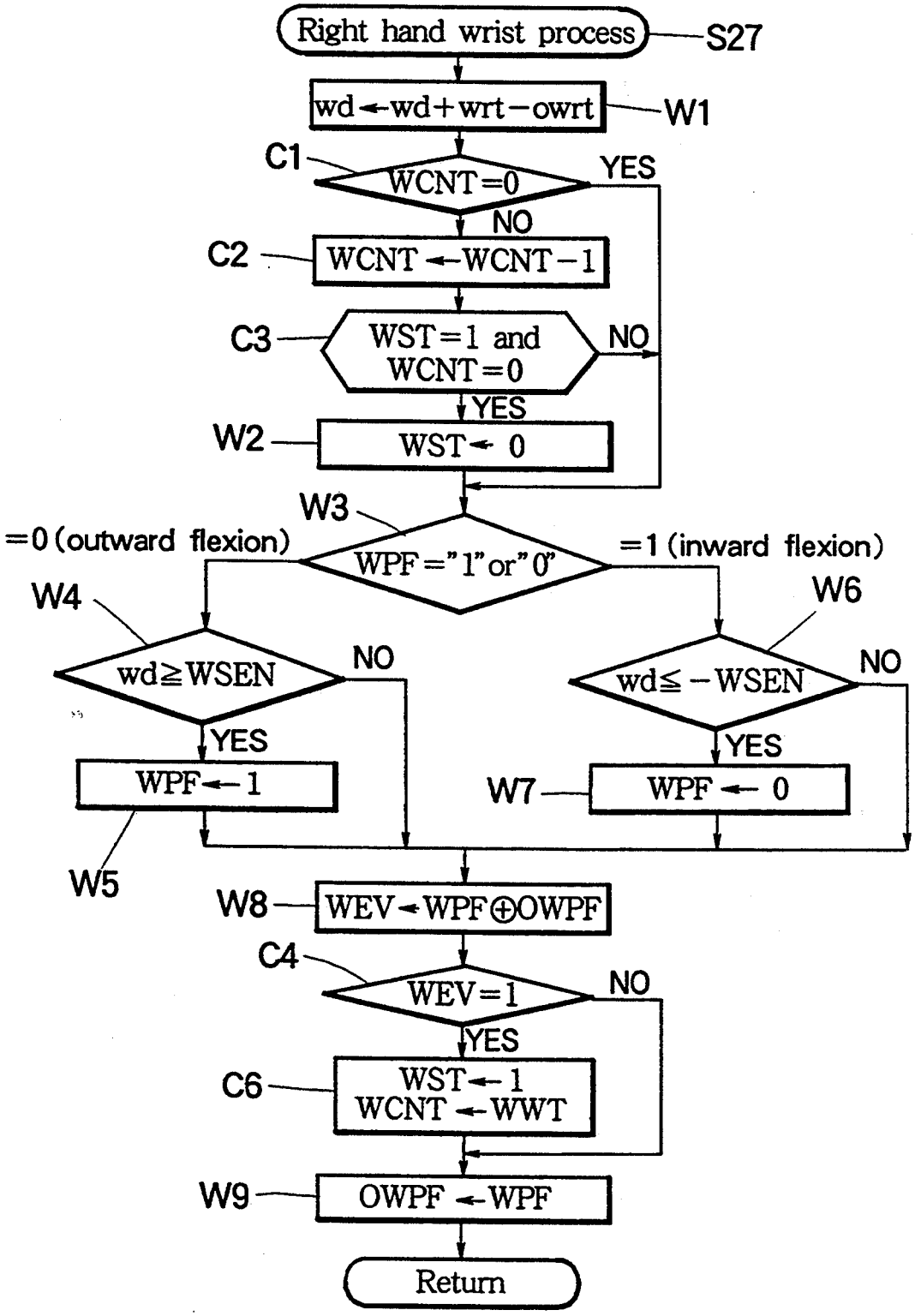
FIG. 29 is a flowchart showing a modification of the FIG. 13 right hand wrist process.

FIG. 29 shows a modification of the FIG. 13 process. This modification is different from the FIG. 13 process in that the Step C5 is eliminated. Namely, if WEV="1" is held in Step C4, the process advances to Step C6 where the flag WST is set to "1" and the counter WCNT is set to a given value WWT.

RIGHT HAND FINGER PROCESS DETAIL

Figure 14:
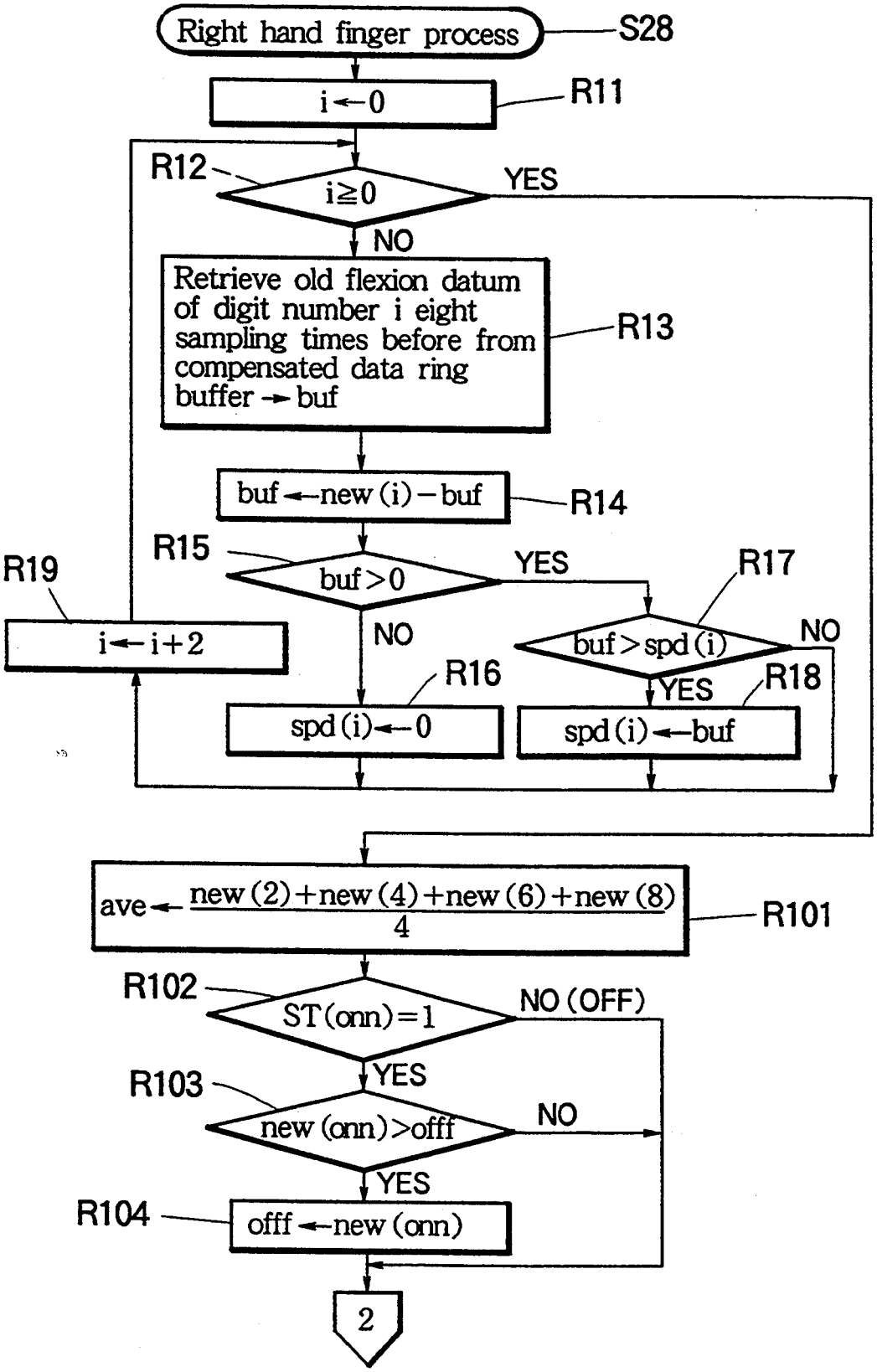
FIGS. 14–19 are a flowchart showing a detail of the right hand finger process.

FIGS. 14–19 are a flowchart showing a subroutine of the right hand finger process S28. Referring first to FIG. 14, in this finger process S28, Step R11 is initiated to reset the digit number i to "0". Checking Step R12 and incrementing Step R19 of incrementing the digit number i by "2" are sequentially carried out to repeatedly execute a loop operation of Step R13 and following Steps every of the fight hand fingers. Firstly in Step R13, the compensated data ring buffer NRB is addressed to retrieve the old finger datum of the i-th finger sampled eight times before, and the retrieved datum is written into the register buf. Then, subsequent Step R14 is undertaken to subtract the old flexion datum of the register buf from the present flexion datum new(i), and the resulting value, i.e., the differential datum relative to the eight sampling times prior datum is set to the same register buf. Next, check is made in Step R15 as to whether the differential datum buf is positive or negative. When the differential datum is not positive, the register spd(i) is set to "0" in Step R16. On the other hand, when the differential datum buf is positive, check is made in subsequent Step R17 as to if the differential datum buf is greater than the content of the register spd(i). If buf>spd(i) is held, the differential datum buf is set into the register spd(i) to update the same in Step R18. Consequently, the maximum value of the differential datum buf is latched in the register spd(i) each right finger while each consecutive differential datum buf has a positive value. By such operation, the register spd(i) is set with the maximum velocity value in the form of the maximum differential datum taken in every time slot of eight sampling times or 64 msec for the respective currently moving fingers. This value of the register spd(i) is utilized as velocity information to determine the velocity value of the initial touch.

Next in Step R101, a mean value of the four flexion data of the fingers F2, F4, F6 and F8 except the thumb F0 is calculated and stored in a register ave. Then, check is made in Step R102 as to whether the state flag ST(onn) of the currently sounding finger associated to the tone generation is set with "1". When the state flag ST(onn)="1" is not held, the process advances to Step R21 and so on shown in FIG. 15. The value of the register ave is also used as the bend depth information to determine the velocity value of the initial touch. On the other hand, when the state flag ST(onn)="1" is held in Step R102, subsequent judgment is made in Step R103 as to if the flexion datum new(onn) of the currently sounding finger is greater than the content of the register offf. If the new(onn)>offf is held, the flexion datum new(onn) is written into the register offf. If new(onn)>offf is not held, the processing advances to Step R21 and further Steps of FIG. 15. Namely, by such operation, when the sounding finger in the ON state is bent further deeply, the latest flexion datum is stored in the register offf as the maximum flexion value while the bend degree becomes deeper. This maximum bend angle datum is utilized as a reference for judgment of key-off event as will be described later.

Figure 15:
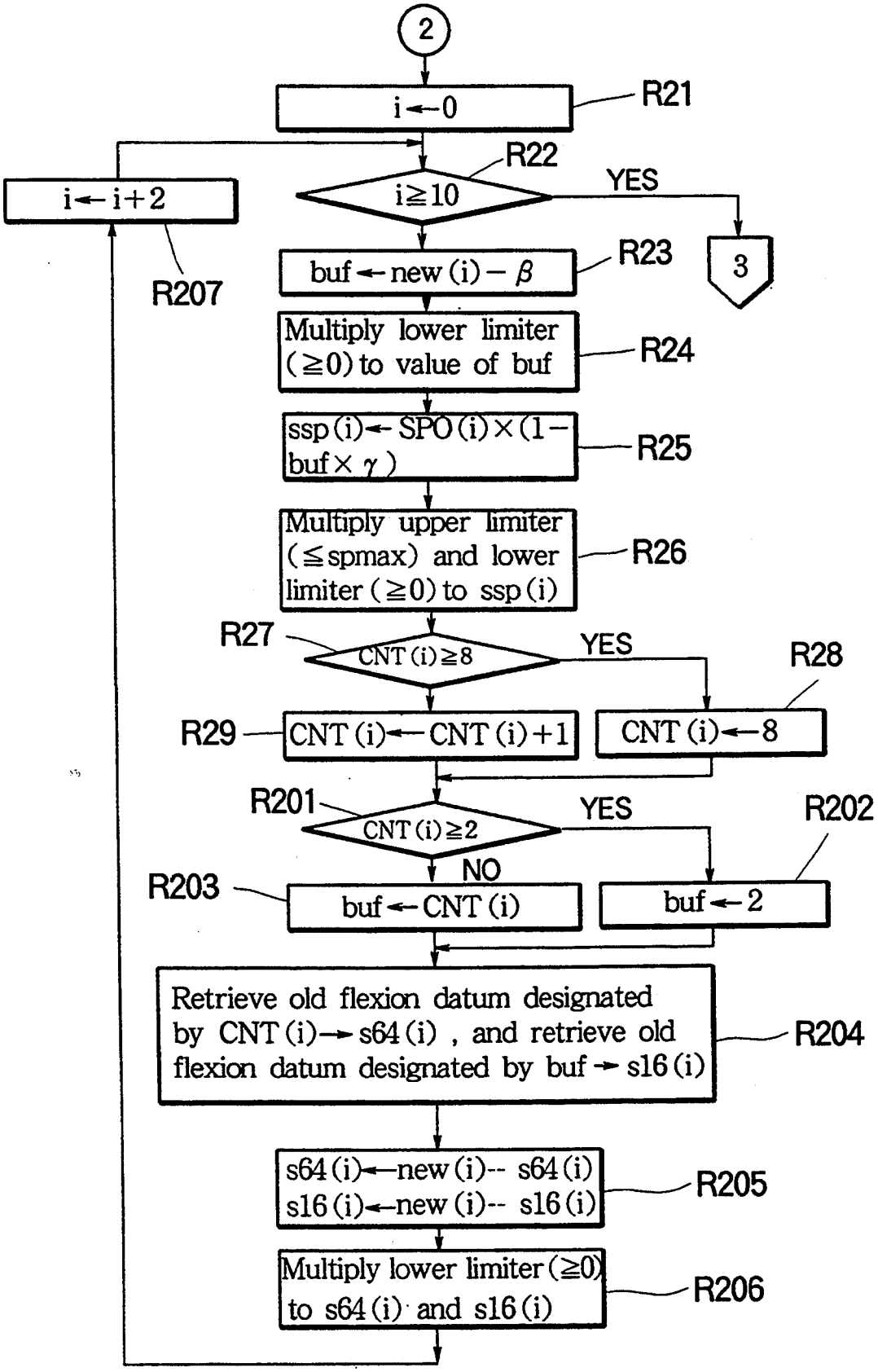
Figure 25:
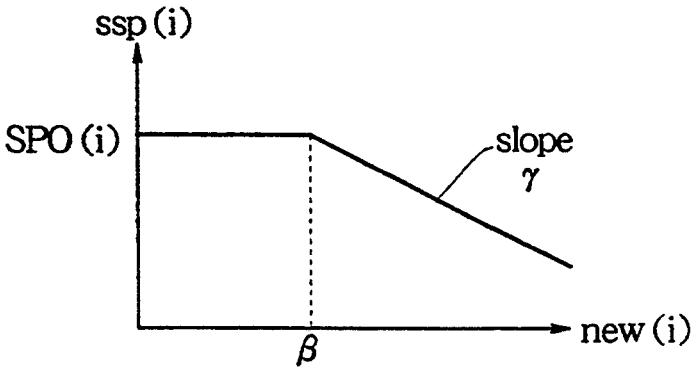
FIG. 25 is a graph showing the relation between a start-threshold value for use in a start motion detection and a finger flexion datum.

Referring to FIG. 15, the digit number i is reset to "0". Then, checking Step R22 and incrementing Step R207 of incrementing digit number i by "2" are sequentially carried out to repeatedly effect a loop operation of Step R23 and following Steps each of the right fingers. Firstly in Step R23, a constant $\beta$ is subtracted from the present flexion datum of the compensated data ring buffer, and the result is stored in the register buf. Then in Step R24, a lower limit of "0" is applied to the content of the register buf such that a negative value of the register buf is limited to "0". Next, the following formula is computed in Step R25:

$$SPO(i)\times(1-buf\times\gamma)$$

where SPO(i) and $\gamma$ are given constants. The computed result is set to the register ssp(i) as the start-threshold value used for start motion detection. Then in subsequent Step R26, an upper limit value spmax and a lower limit value "0" are applied to the value of the register ssp(i). Consequently, the relation between the value of ssp(i) and the value of new(i) is represented in the graph of FIG. 25.

Next, check is made in Step R27 as to if the content of the counter CNT(i)≧"8". When CNT(i)≧"8" is held, the counter CNT(i) is set to "8" in Step R28, thereafter advancing to Step R201. On the other hand, when CNT(i)≧"8" is not held, the counter CNT(i) is incremented in Step R29 to thereby advance to Step R201. Check is made in Step R201 as to if CNT(i)≧2. When CNT(i)≧2 is held, the register buf is set with "2" in Step R202, thereby advancing to Step R204. If CNT(i)≧2 is not held, the content of the counter CNT(i) is set to the register buf, thereby advancing to Step R204. In these operations, the counter CNT(i) is reset upon stop motion detection of the i-th finger. The process of Steps R27–R203 is repeatedly carried out so that the CNT(i) is incremented to maintain the value "8" at maximum, while the content of register buf is incremented in the order of "0", "1" and "2" to thereby maintain the value "2" at maximum. These contents of counter CNT(i) and register buf are utilized to designate particular past flexion data retrieved from the compensated data ring buffer NRB so as to obtain current flexion velocity information. Namely, the old flexion datum before 64 msec duration is retrieved according to "8" held in the counter CNT(i) and the other old flexion datum before 16 msec duration is retrieved according to "2" held in the register buf. Stated otherwise, Step R204 is carried out such that the compensated data ring buffer NRB is addressed by "CNT(i)" to retrieve the old datum before eight sampling times and is also addressed by "buf" to retrieve the other old datum before two sampling times. The respective retrieved data are stored in the registers s64(i) and s16(i). In subsequent Step R205, the value of the register s64(i) is subtracted from the present flexion datum new(i), and the resulting differential datum is written into the same register s64(i). In similar manner, the value of the register s16(i) is subtracted from the present flexion datum new(i), and the resulting differential datum is returned to the same register s16(i). Further in Step R206, the values of the respective registers s64(i) and s16(i) are applied with a lower limit "0", thereby advancing to Step R207. By these operations, there can be obtained the differential datum per 64 msec time slot and the other differential datum per 16 msec time slot, which represent a current bending velocity used for the detection of the finger motion. After completing the above noted process each of the right hand fingers, the processing advances from . Step R22 to Step R31 of FIG. 16.

Figure 16:
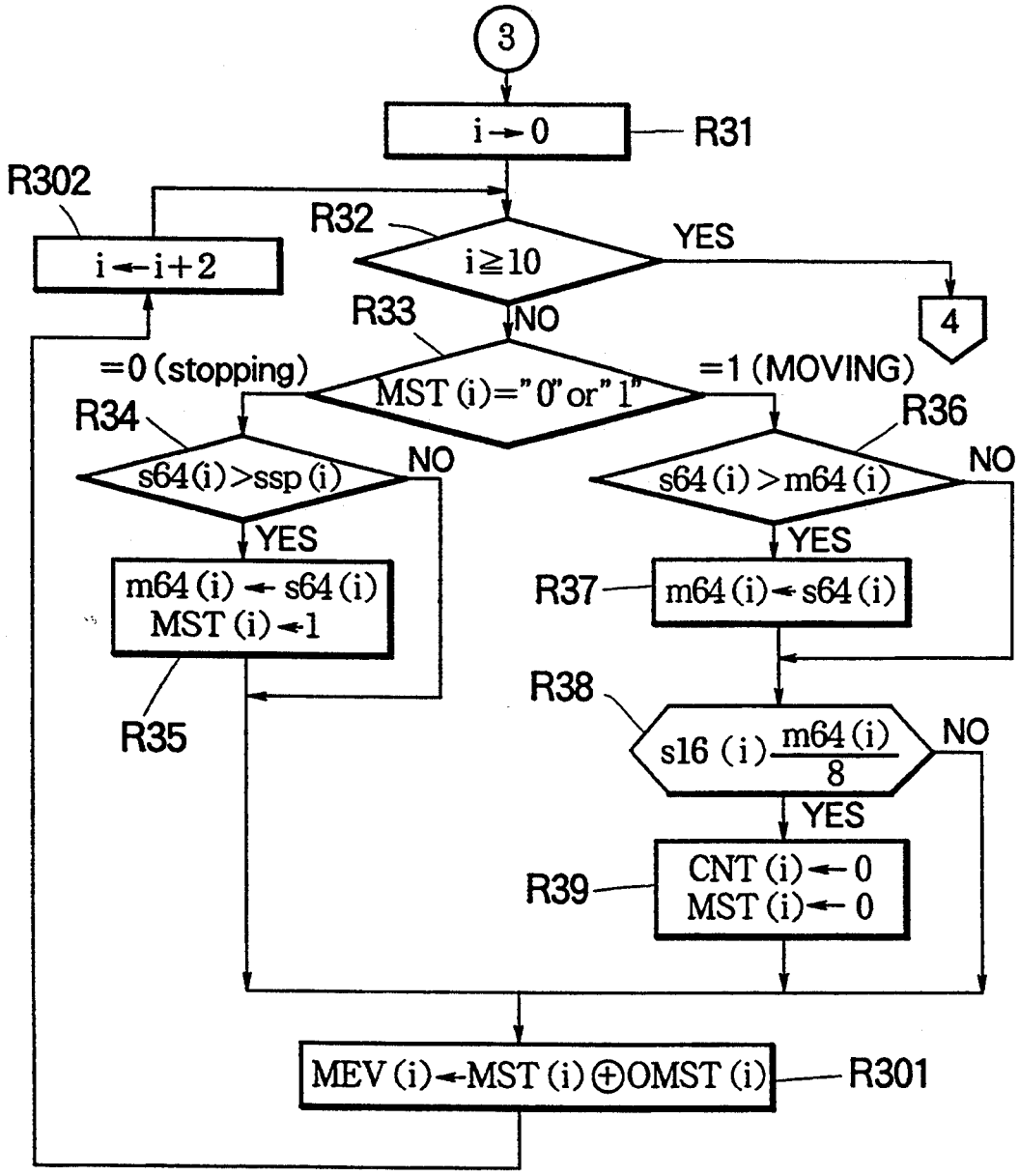
Figure 17:
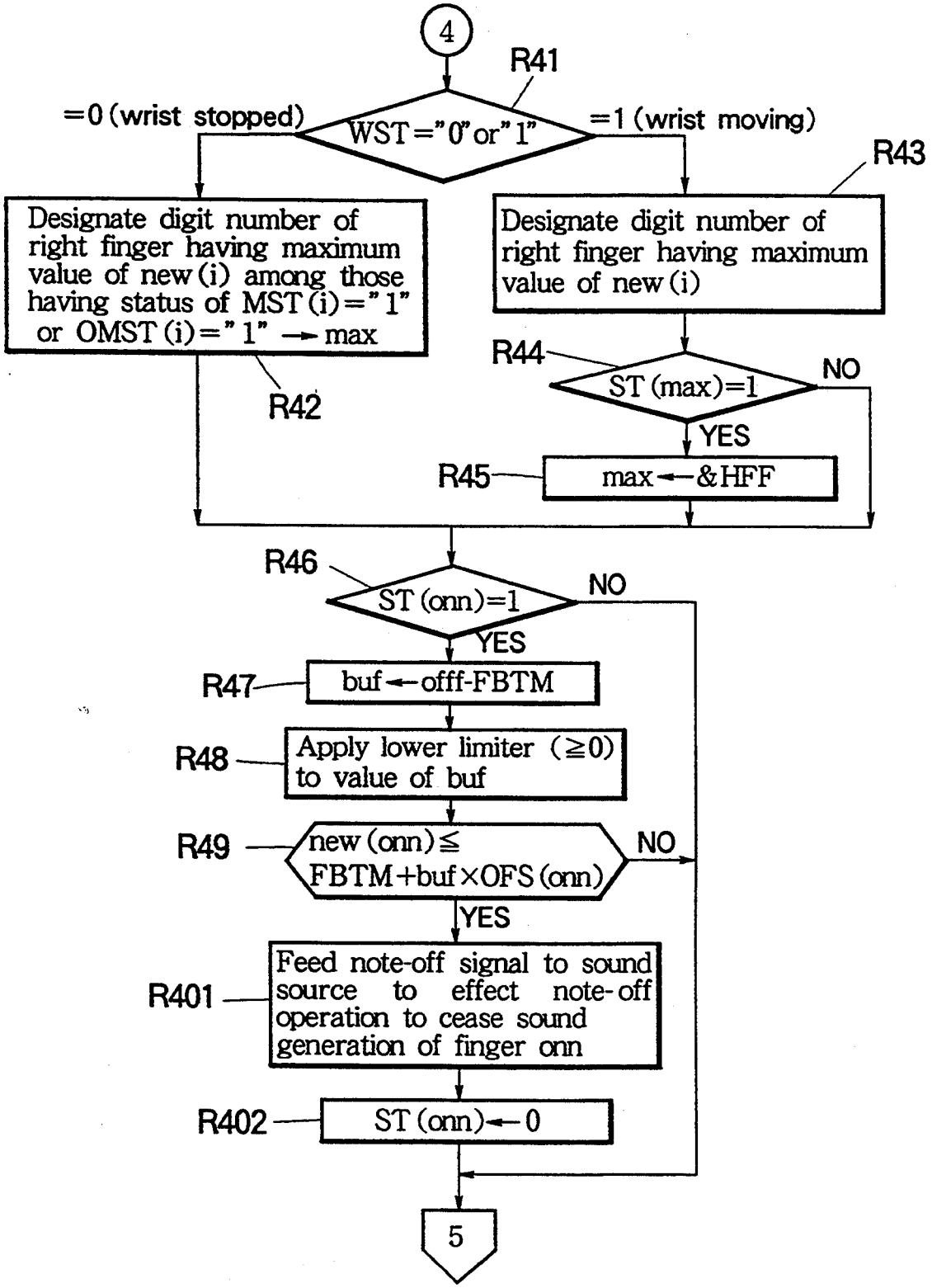

In the process of FIG. 16, firstly the digit number i is reset to "0" in Step R31. Then, checking Step R32 and incrementing Step R302 of incrementing the digit number i by "2" are sequentially carried out to repeatedly execute a loop operation of Step R33 and following Steps for respective one of the right fingers. In Step R33, the motion state flag MST(i) is accessed to check as to whether a given finger is in the moving state or the stop state. When the motion state flag MST(i)="0" is held to indicate that the finger has been stopped in the previous sampling time, subsequent check is made in Step R34 as to whether the 64 msec differential datum s64(i) exceeds the value ssp(i). When s64(i) does not exceed ssp(i), the processing advances to Step R301. When s64(i)>ssp(i) is held, the 64 msec differential datum s64(i) is stored in a register m64(i) at Step R35, and the motion state flag MST(i) is set to "1" upon detection of the start motion to indicate that the finger is shifted from the stopped state to the moving state, thereby proceeding to Step R301. In this operation, the value of the register ssp(i) used in the above judgment Step R34 represents the start-threshold velocity value obtained by the before-described Step R26 for the start motion detection. As indicated in FIG. 25, this start-threshold value ssp(i) is determined smaller as the bend degree of the finger is deeper, and is determined greater as the bend degree is shallower. Therefore, the start motion can be effectively judged even by relatively slow velocity when the finger has been deeply bent, as compared to the case when the finger has been bent shallowly, thereby avoiding delay of the start motion detection in the deeply bent state.

In turn, when the motion state flag MST(i)="1" is found in Step R33 to show that the finger is in the moving state, subsequent check is made in Step R36 as to if the 64 msec differential datum s64(i) exceeds the value of the register m64(i). When s64(i)>m64(i) is not held, the processing advances to Step R38. On the other hand, when s64(i)>m64(i) is held, the 64 msec differential datum s64(i) is written into the register m64(i) in Step R37. By this operation, when the bending velocity increases during the course of the flexional movement, the latest 64 msec differential datum s64(i) is written as the currently maximum velocity value into the register m64(i) successively. In subsequent Step R38, judgment is made as to whether the current 16 msec differential datum s16(i) becomes lower than one-eighth of the maximum velocity value m64(i). When s16(i)≦m64(i)/8 is not held, the processing advances to Step R301. On the other hand, when s 16(i)≦m64(i)/8 is held, the counter CNT(i) and the motion state flag MST(i) are reset to "0", thereafter proceeding to Step R301. One-eighth of the maximum value m64(i) represents a mean 8 msec differential datum of the maximum velocity. The stop motion detection is judged when the 16 msec differential datum s16(i) falls below this mean 8 msec differential datum, i.e., when the current velocity becomes about half of the maximum velocity. By this operation, key-on event occurs in response to the flexional movement of the finger to thereby avoid delay of the key-on event detection. Lastly in Step R301, exclusive logical OR operation is taken between the old motion state flag OMST(i) set by Step S26 of the glove process routine and the current motion state flag MST(i) so as to detect start event/stop event, and the result of the logical operation is written into the motion event flag MEV(i), thereafter advancing to Step R302.

After completing the start motion state detection, the stop motion state detection and the motion event detection as described above, the process proceeds to Step R41 of FIG. 17. Step R41 is carried out to access the flag WST which is set in the right hand wrist process so as to check as to whether the right hand wrist is in the moving state or in the stopped state. When the flag WST="0" is found in case of the stopped state of the wrist, Step R42 is undertaken such as to designate a particular finger having a maximum flexion value of new(i) among right fingers which have the motion state flag MST(i)="1" or the old motion state flag OMST(i)="1". The digit number of the designated finger is recorded in the register max as a candidate for a note-on finger, thereby advancing to Step R46. On the other hand, when the flag WST="1" is held in case of the moving state of the wrist, Step R43 is selected to designate a particular finger having the maximum value of new(i) among the right fingers without regard to their motion states. The digit number of the designated finger is recorded in the register max as a candidate of a note-on finger, thereafter proceeding to Step R44. The operation of Step R43 is based on the facts that a shallowly bend finger may not be a true note-on finger even in the moving state when the wrist is also in the moving state, and that the most deeply bent finger even in the stopped state relative to the corresponding bend sensor 10 may be a true note-on finger effective to initiate tone generation by flexing the wrist. Subsequent check is made in Step R44 as to whether the state flag ST(max)="1", i.e. whether the candidate finger (the most deeply bent finger) is already placed in the ON state. If ST(max)="1" is not held, the processing advances to Step R46. On the other hand, if ST(max)="1" is held, the register max is written with a datum "&HFF" which indicates an invalid candidate in Step R45, thereafter proceeding to Step R46.

Figures 26, 27:
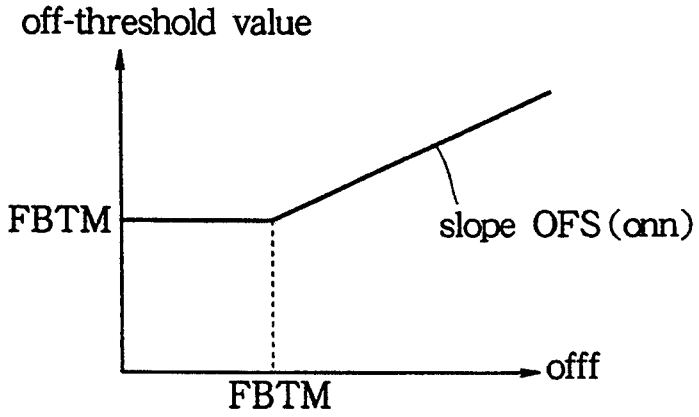
FIG. 26 is a graph showing the relation between an off-threshold value for use in a note-off judgement and a maximum flexion datum.
FIG. 27 is a diagram showing an octave shift table.

In order to ensure the accurate operation, Step R46 is executed to check as to if the state flag ST(onn)="1". If ST(onn)="1" is held, note-off operation is carried out at Step R47 and following Steps. If ST(onn)="1" is not held, the processing advances to Step R51 of FIG. 18. When the state flag ST(onn) indicates "1", a constant value FBTM is subtracted from the value of the register offf which indicates the maximum bend degree of the finger indicated by the digit number onn, and the calculated result is written into the register buf in Step R47. Then, the value of the register buf is applied with a lower limiter "0" in Step R48. Namely, if the value of the register offf is greater than the given constant FBTM, the difference therebetween is stored in the register buf. In turn, if the value of offf is smaller than the constant FBTM, the value "0" is stored in the register buf. Next, Step R49 is carried out to check as to if the flexion datum new(onn) of the sounding finger is smaller than a given value calculated by the following formula:

$$FBTM + buf \times OFS(onn)$$

where OFS(i) denotes a given constant. This calculated value determines the off-threshold value used for judging a note-off event. FIG. 26 shows the relation between the value of the register offf and the calculated off-threshold value. When the check of Step S49 finds that the flexion datum new(onn) is greater than the calculated off-threshold value, the processing advances to Step R51 of FIG. 18. On the other hand, when new(onn) is less than the off-threshold value, the note-off operation is executed in subsequent Step R401. Then, the state flag ST(onn) is reset to "0" in Step R402, thereby proceeding to Step R51 of FIG. 18. In this operation, as shown in FIG. 26, the deeper the finger flexion degree offf, the greater the off-threshold value of the above noted formula. The shallower the finger flexion degree offf, the smaller the off-threshold value. Consequently, when the flexion degree falls below the constant FBTM, the note-off operation is triggered definitely. When the finger has been bent deeper than the constant level of FBTM during the course of the note-on operation, the off-threshold value is adjustably raised according to the bend degree of the turned-on finger, so that the note-off event is detected in a relatively deep position when the bend degree is relatively great. By this operation, delay of the note-off event detection can be avoided in case that the turned-on finger is placed in a relatively deep position. A single tone generation mode is adopted in this embodiment, hence the note-off information is transferred to the sound source circuit 5 in the note-off operation of Step R401 so as to effect cease of the tone generation.

Figure 18:
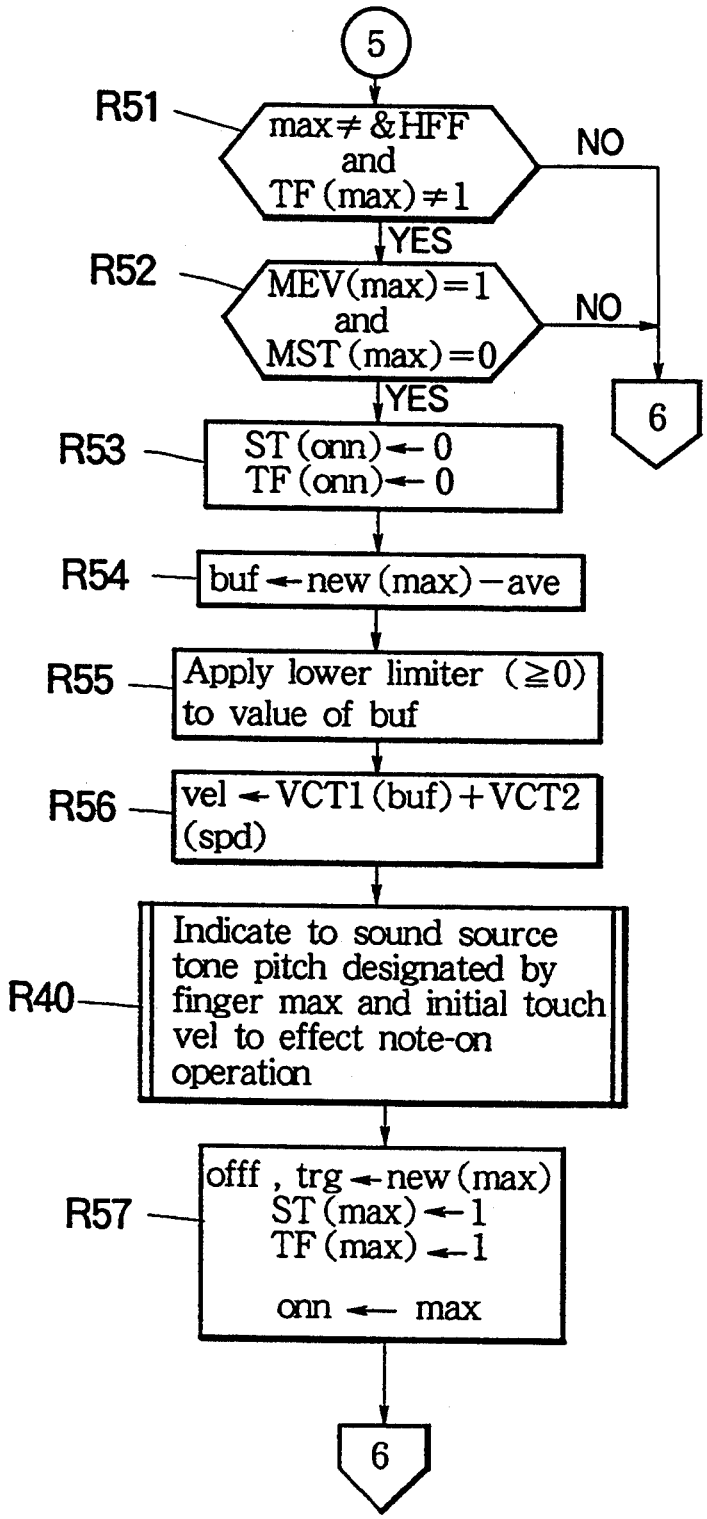

Next, in Step R51 of FIG. 18, judgment is made as to if the following condition is satisfied: the register max does not indicate the invalid datum "&HFF" and a flag TF(max) does not indicate "1" which denotes inhibition of tone generation. The flag TF(i) is settable with "1" which denotes inhibition of the tone generation with respect to the digit number i or settable with "0" which denotes allowance of the tone generation. When Step R51 proves that the condition is satisfied, i.e., when the particular finger nominated for the note-on operation is not sounding currently and is allowed to generate a tone, subsequent Step R52 is undertaken. On the other hand that the condition is not satisfied, the processing advances to Step R61 of FIG. 19. Step R52 checks as to if the following condition is satisfied: the motion event flag MEV(max)="1" and the motion state flag MST(max)="0". When the condition is satisfied, the state flag ST(onn) and the flag TF(onn) are reset to "0", thereby advancing to Step R54. On the other hand that the condition is not satisfied, the processing branches to Step R61 of FIG. 19. Step R52 is executed to judge as to if the particular finger nominated for the note-on operation has the start event status and the stopped state status in order to detect or confirm the stop event of the nominated finger. Further, Step R53 is executed to set the note-off state for the finger which has been placed in the note-on state.

Next Step R54 is carried out such as to calculate a deviation of the flexion datum new(max) from the mean value ave of the flexion data of the right fingers. The calculated deviation is stored in the register buf. In Step R55, the content of the register buf is applied with a lower limiter "0". Then, in Step R56, a velocity value is calculated according to the value of the register buf and the value of the register spd(i) to determine the initial touch and the calculated velocity value is stored in a register vel. The velocity value calculated in Step R56 is obtained as a sum of one value VCT1 (buf) which is retrieved from the velocity curve table VCT1 in function of the deviation or depth latched in the register buf and another value VCT2(spd) which is retrieved from the other velocity curve table VCT2 in function of the velocity datum spd(i) of the finger. After calculating the velocity value vel, Step R40 is undertaken to effect the note-on operation as will be described later in detail. Upon completion of the note-on operation, subsequent Step R57 is executed such that the state flag ST(max) and the flag TF(max) are set to "1" to memorize the key-on state of the newly sounding finger and to inhibit resounding thereof hereafter, while the digit number of the register max is reserved in the register onn. Further, the flexion datum new(max) of the currently turned-on finger is stored in the register offf as an initial value of the note-off detection reference angle, and the same datum new(max) is also stored as an initial value in the register trg for releasing the resounding inhibition state. Thereafter, the process proceeds to Step R61 of FIG. 19.

Figure 19:
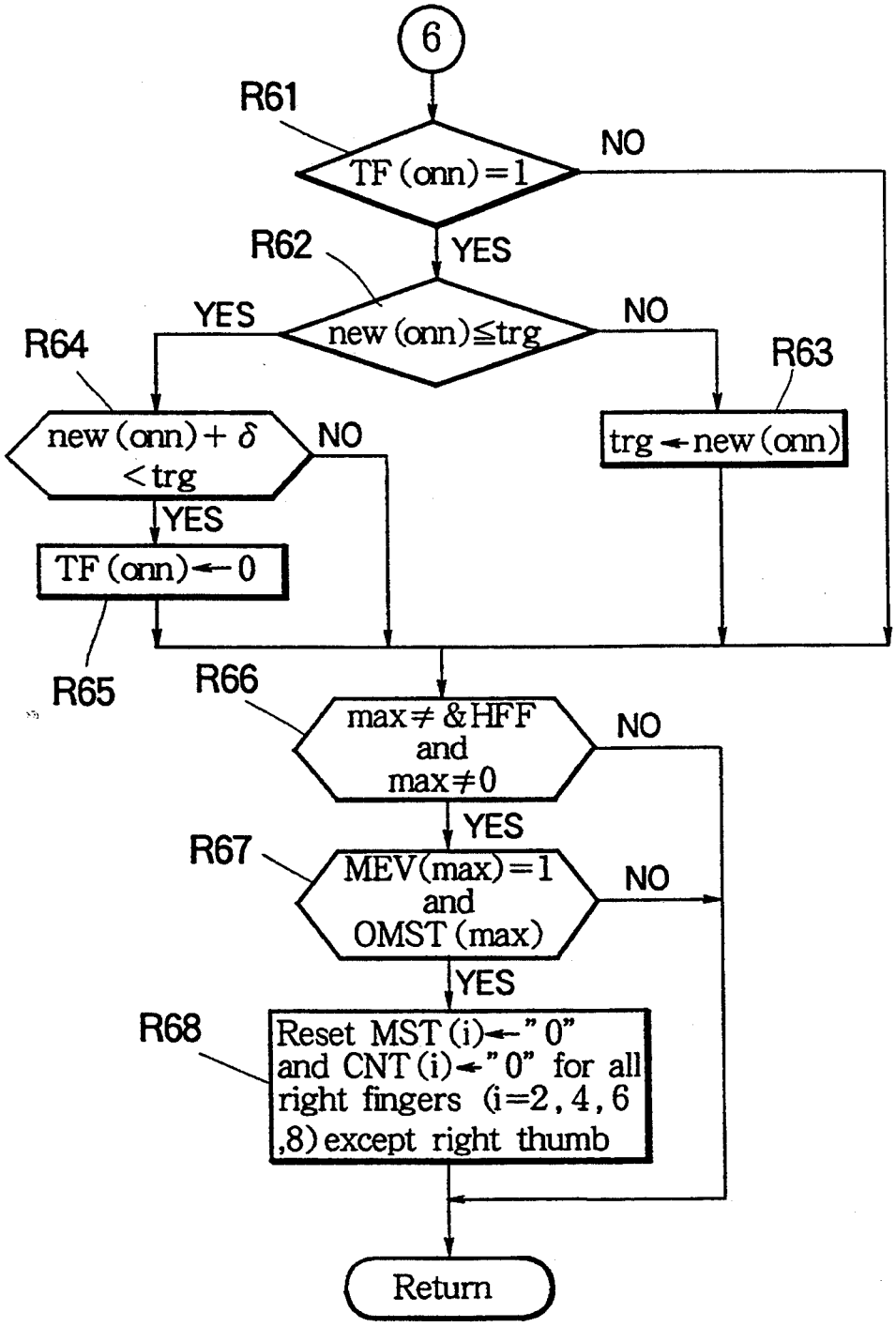

In Step R61 of FIG. 19, check is made as to whether the flag TF(onn)="1". When TF(onn)="1" is not held, i.e., when resounding is not inhibited, the process advances to Step R66. On the other hand that TF(onn)="1" is held, that is, resounding is inhibited, subsequent check is made in Step R62 as to if the flexion datum new(onn) of the currently sounding finger is lower than the value of the register trg. When Step R62 finds that the flexion datum new(onn) exceeds or equals to the value of the register trg, subsequent Step R63 is undertaken to replace the content of the register trg by the flexion datum new(onn), thereby advancing to Step R66. On the other hand that the flexion datum new(onn) is lower than the value of the register trg, Step R64 is undertaken to check as to if the sum of the flexion datum new(onn) and a constant value δ is smaller than the value of the register trg. When the sum is not smaller than trg, the process advances to Step R66. On the other hand that the sum is smaller than trg, Step R65 is undertaken to reset the flag FT(onn) to "0" so as to release the resounding inhibition, thereafter proceeding to Step R66. In these operations, when the currently sounding finger is further bent forward, the register trg is accordingly updated through Steps R62, R63. When it is detected by the checking of Step R64 that the currently sounding finger is flexed reversely below the value of the register trg by the given constant δ, the resounding inhibition is released. Namely, the finger of the key-on state can be reversely flexed from the deepest bend position by the allowance constant δ to release its own resounding inhibition status. As long as the key-on state finger is confined within the allowance δ, its resounding inhibition status is kept. This operation can effectively enable resounding and can avoid inadvertent resounding.

Next, judgment is made in Step R66 as to if the following condition is satisfied: the content of the register max does not coincide with the invalid datum "&HFF", and the same register max does not indicate "0". When the condition is not satisfied, the processing returns to the performing glove process routine. On the other hand that the condition is satisfied, subsequent check is made in Step R67 as to if the following condition is satisfied: the motion event flag MEV(max) indicates "1" and the motion state flag OMST(max) indicates "0". When Step R67 finds that the condition is not satisfied, the processing returns to the glove process routine. On the other hand that the condition is satisfied, subsequent Step R68 is undertaken to write "0" into the motion state flag MST(i) and the counter CNT(i) for all of the right fingers except the right thumb, thereafter returning to the glove process routine. Namely, when the stop event is detected for the finger indicated by max except the thumb, all of the right fingers other than the thumb are judged to be in the stopped or rest state. Thus, when one finger is placed in the key-on state to generate a tone, the remaining fingers are prevented from abrupt sounding to thereby avoid inadvertent tone generation.

Figure 20:
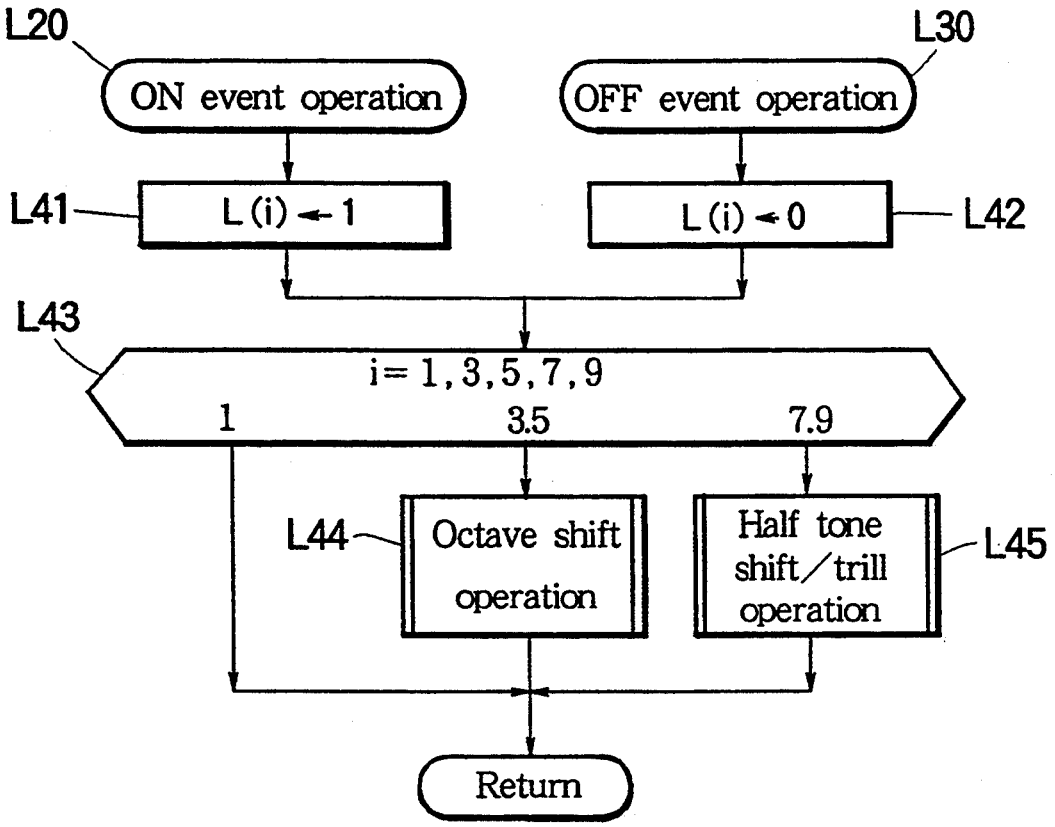
FIG. 20 is a flowchart showing on-event and off-event processes of the left hand fingers.

After effecting the key-on/key-off detection of the left and right fingers by the above described operations, the program further proceeds to the ON event operation L20 of the left fingers, the OFF event operation L30 of the left fingers, and the note-on operation R40 of the right fingers. FIG. 20 is a flowchart showing a subroutine called when executing the ON event operation L20 and the OFF event operation L30 during the course of the left finger process. In the ON event operation L20, firstly Step L41 is carried out to set "1" to a register L(i), thereby advancing to Step L43. In the OFF event operation L30, Step L42 is carried out to set "0" to the register L(i), thereby advancing to Step L43. Step L43 effects branching operation according to the digit number i. In case of i="1", the process returns to the left finger process routine of FIG. 12. In case of i="3" or "5", Step L44 is selected to carry out the octave shift operation of FIG. 21, thereafter returning to the left finger process routine. Further in case of i="7" or "9", Step L45 is selected to effect the half tone shift/trill operation shown in FIG. 22, thereafter returning to the left finger process routine.

Figure 21:
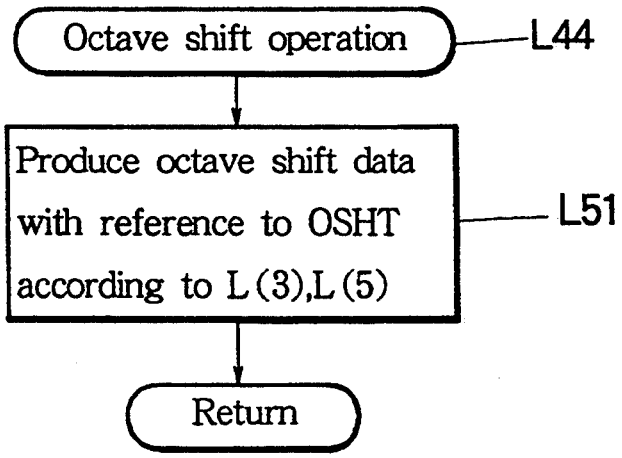
FIG. 21 is a flowchart showing an octave shift process.

In the octave shift operation L44 of FIG. 21, Step L51 is carried out to set an octave shift datum OS to the register OS, based on ON/OFF "1"/"0", in other words, the status of the registers L(3) and L(5) with reference to the octave shift table OSHT shown in FIG. 27, thereby returning.

Figure 22:
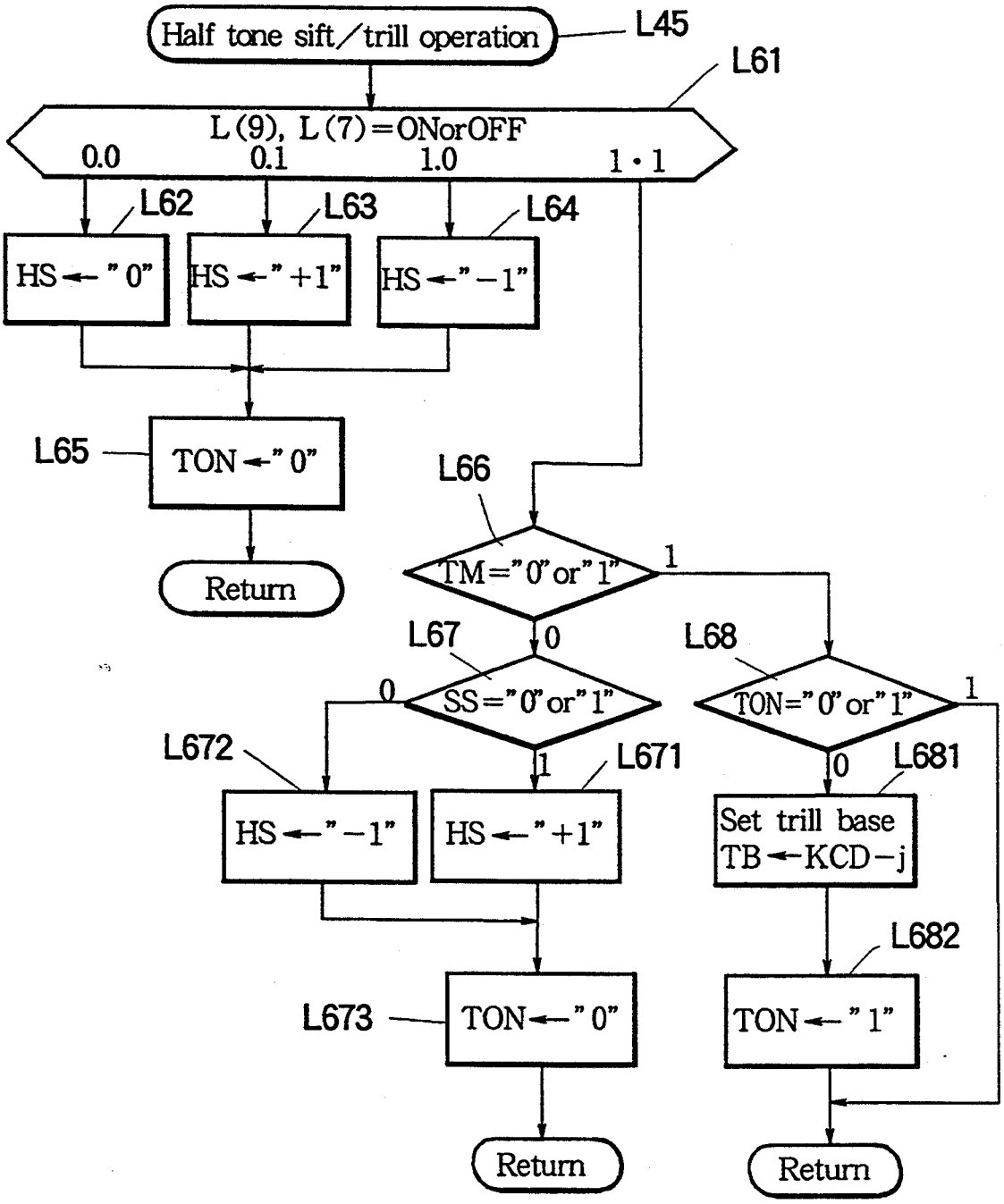
FIG. 22 is a flowchart showing a half tone shift/trill process.

In the half tone shift/trill operation L45 of FIG. 22, first Step L61 is carried out to check the ON/OFF status of the registers L(7) and L(9). In case of L(7)=OFF and L(9)=OFF, Step L62 is undertaken to set the half tone shift register HS with "0". In case of L(7)=ON and L(9)=OFF, Step L63 is undertaken to set the register HS with "1∞. In case of L(7)=OFF and L(9)=ON, Step L64 is undertaken to set the register HS with "−1". Then, subsequent Step L65 is carried out to reset a trill-on flag TON, thereby returning.

On the other hand, when L(7)=ON and L(9)=ON is found in Step L61, Step L66 is executed to check the trill mode flag TM. In one case of TM="0", the process branches to Step L67 and following Steps of the priority mode. In another case of TM="1", the process branches to Step L68 and further Steps of the trill mode. Step L67 is carded out to check as to which of # and b is given the priority according to the value of the register SS. In case that the priority is given to #, Step L671 is selected to set the register HS with "+1". Then, Step L673 is undertaken to reset the trill-on flag TON, thereby returning. In case that the priority is given to b, Step L672 is selected to set the register HS with "−1". Then, Step L673 is undertaken to reset the trill-on flag TON, thereby returning. On the other hand, in Step L68 of the trill mode, the trill-on flag TON is checked, thereby immediately returning in case of TON="0". In case of TON="1", Step L681 is undertaken to set a trill base TB which contains reference tone pitch information effective to determine a tone pitch group of semitone scale. Subsequently in Step L682, the trill-on flag TON is set to "1", thereby returning. In Step L681, a register j is set with a k value which is a sum of a value "1" and a half of the digit number of the right finger placed in the key-on state by the right hand note-on operation. The trill base TB is set to a certain value which is calculated by subtracting j from the currently designated key code KCD.

Figure 23:
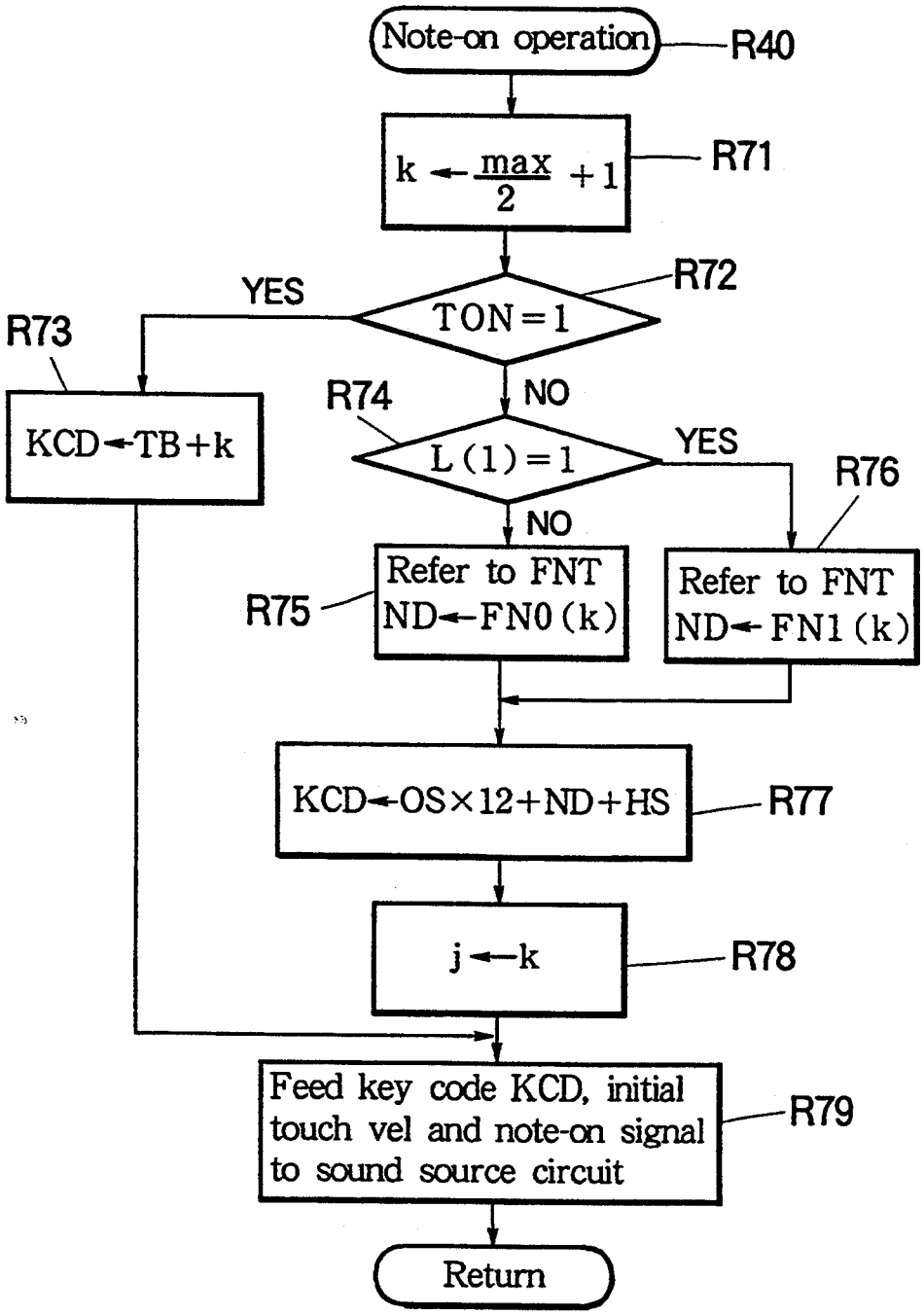
FIG. 23 is a flowchart showing a note-on process of the fight hand fingers.

FIG. 23 is a flowchart showing the note-on operation R40 of the right hand finger process. When this note-on process R40 is initiated, there have been set the digit number max of the particular right finger on which is detected the key-on state, and the velocity value vel of the initial touch. Firstly in Step R71, the register k is set with a certain value which is a sum of the value "1" and a half value of the digit number max. The value of the register k denotes a sequence number of a right finger counted from the right thumb. Next, check is made in Step R72 as to if the trill-on flag TON is set with "1". When TON="1" is held, Step R73 is undertaken to set the keycode register KCD with the value TB+k, thereafter advancing to Step S79. On the other hand that the trill-on flag TON is set with "0", Step R74 is undertaken to check as to the ON/OFF status of L(1). In case of L(1)=OFF, Step R75 is undertaken to retrieve FNO(k) based on the sequence number k from the finger note table FNT shown in FIG. 28, and the retrieved FNO(k) is set in the register ND. On the other hand that L(1)=ON is found, Step R76 is undertaken to retrieve FN1(k) from the finger note table FNT, and the retrieved FN1(k) is set in the register ND. Subsequently in Step R77, the key code register KCD is loaded with a value of OS×12+ND+HS. Then in Step R78, the register j is set with the value of the register k, thereafter advancing to Step R79. Lastly, Step R79 is effected to feed the key code KCD, the velocity value vel, and the note-on signal to the sound source circuit 5 to generate musical tones, thereby returning to the right hand finger process routine.

In the above described embodiment, the stop motion is judged when the velocity of the forwardly moving finger is reduced to about a half of its maximum velocity to thereby detect the key-on event. By such operation, a musical tone can be generated in a practically real timing responsively to the physical flexional movement of the fingers in contrast to the prior art in which the key-on event is detected when the forward bend amount exceeds a certain threshold.

The stop motion detection is undertaken for a certain finger which has started a forward bending movement. In this case, the start motion is judged by a relatively slow bending velocity when the finger has been placed in a relatively deep bent attitude. By such operation, the tone generation timing is adequately determined according to the initial attitude of each finger without delay.

Further, the furthest forward bend degree is monitored for a finger in the note-on state. Then, the off-threshold value of the note-off event is determined for that finger according to its monitored furthest forward bend degree. By such operation, a delay of the note-off detection timing can be effectively avoided in contrast to the prior an in which the key-off event is detected when a reverse stretch amount of the finger exceeds a certain level.

The flexional movement of the wrist is also detected in this embodiment. When the wrist is flexed, the most deeply bent finger is designated as a candidate for note-on operation without regard to stop/move state of respective fingers, thereby avoiding inadvertent tone generation by incidental movement of the fingers while the wrist is flexing, and thereby enabling performance by the wrist.

In this embodiment, compensation is effected in the left hand finger process for incidental movement of a subordinate finger in a shallower position, affected by strong movement of an adjacent dominant finger in a deeper position. Further, the compensation amount is decreased as the subordinate finger is relatively bent deeply, thereby reflecting accurately the actual incidental and spontaneous movement of a finger pair.

The velocity value of the initial touch is determined by the bend degree of the finger as well as the velocity information of the finger. The initial touch effect can be obtained to increase a tone volume by deeply bending the finger even though the finger cannot be flexed quickly in the deeper bend degree.

As described above, according to the invention, the musical tone control device is constructed such that key-on and key-off are judged based on the bend degree of the fingers so as to control the sounding of musical tone by the key-on detection and to control the silencing of musical tone by the key-off detection. In this device, the stop motion of the finger is detected based on the bending velocity of the finger. Then, the key-on is judged by the detection of the finger stop motion so as to generate musical tones. Thus, the tone generation timing can match with the physical finger movement of the performer. Further, according to the present invention, the maximum bend depth is detected of a particular finger placed in the key-on state. Then, the off-threshold value is set to a certain bend level which is shallower than the detected maximum bend depth and which is linked to the detected maximum bend depth.

The key-off event is judged by the reverse stretching amount of that finger restored from the key-on state, with reference to the variably set off-threshold value, thereby silencing or erasing the musical tone. By such operation, when the finger is restored from the deeply bent position in the key-on state, the key-off event is adequately judged by the accordingly set off-threshold level. Thus, the erasing timing of the tone can be matched with the physical fingering of the performer. Consequently in the inventive musical tone control device, the musical tone can be controlled in practically exact synchronization with the performing movement to thereby facilitate playing manner of the electronic music instrument.

What is claimed is:

1. An apparatus operative to sequentially sample a flexion amount of a joint of a player's body in forward and reverse directions for determining a key-on event according to the sampled flexion amounts so as to control generation of a musical tone upon determination of a key-on event, the apparatus comprising:

velocity detecting means for detecting a forward flexion velocity of a finger based on the sequentially sampled forward flexion amounts;

stop detecting means for detecting a stop motion of the finger based on the detected forward flexion velocity; and key-on determining means responsive to the stop motion for determining the occurrence of a key-on event.

2. An apparatus according to claim 1 further including:

maximum depth detecting means for detecting a maximum bend depth of the finger placed in a key-on state after the stop motion according to the sampled forward flexion amount;

off-threshold setting means for setting an off-threshold level which is determined shallower than the detected maximum bend depth and which is correlated to the detected maximum bend depth;

and key-off determining means for determining a key-off event according to a reverse flexion amount of the finger restored from the key-on state in reference to the set off-threshold level.

3. An apparatus according to claim 1 further including:

start-threshold setting means for setting a start-threshold velocity in adverse relation to a sampled flexion amount of a finger held in an initial position;

and start detecting means for detecting a start motion of the finger according to an initial forward flexion velocity thereof in reference to the start-threshold velocity.

4. An apparatus according to claim 1 further including initial touch detecting means for detecting an initial touch associated to the key-on event and effective to determine a volume of a tone generation according to the forward flexion velocity and the forward flexion amount.

5. An apparatus according to claim 1 further including:

wrist flexion detecting means for detecting a physical flexional movement of a wrist; and designating means operative when the flexional movement of the wrist is detected for designating a particular one of the most deeply bent finger as a candidate for a following key-on event.

6. An apparatus according to claim 1 further including compensating means for compensating a sampled forward flexion amount of a subordinate finger which tends to flex incidentally to a flexional movement of a dominant finger adjacent to the subordinate finger.

7. An apparatus according to claim 6 wherein the compensating means includes means for decreasing a compensation amount as the forward flexion amount of the subordinate finger increases.

8. An apparatus according to claim 1, wherein the stop detecting means comprises means for detecting the stop motion when the forward flexion velocity falls below a predetermined value.

9. An apparatus according to claim 1, wherein the stop detecting means comprises means for detecting the stop motion when the forward flexion velocity falls from a maximum forward flexion velocity by a predetermined value.

10. An apparatus operative to sequentially sample a flexion amount of a finger in forward and reverse directions for determining key-on and key-off events according to the sampled flexion amounts so as to control generation of a musical tone upon determination of a key-on event and to control erase of a musical tone upon determination of a key-off event, the apparatus comprising:

maximum depth detecting means for detecting a maximum bend depth of the finger according to the sampled forward flexion amount during the course of determination of the key-on event;

off-threshold setting means for setting an off-threshold level which is determined shallower than the detected maximum bend depth and which is correlated to the detected maximum bend depth; and key-off determining means for determining a key-off event according to sequentially sampled reverse flexion amounts of the finger restored from a key-on state in reference to the set off-threshold level.

11. A musical tone control apparatus operative to sense a flexion amount of fingers to determine an on-operation and an off-operation of the fingers according to the flexion amount and a predetermined threshold value so as to control a musical tone based on the determined on-operation and off-operation, the apparatus comprising: calculating means for calculating a difference between a pair of flexion amounts sensed with respect to a pair of adjacent fingers; compensating means for decreasing a smaller one of the pair of flexion amounts according to the calculated difference to produce a compensated flexion amount; and determining means for determining an on-operation and an off-operation according to the compensated flexion amount with respect to one of the adjacent pair of fingers, which has a smaller flexion amount.

12. A musical tone control apparatus comprising: finger motion sensing means for sensing a bending motion of a finger of a hand; musical tone controlling means for controlling generation of a musical tone according to the sensed bending motion of the finger; wrist movement sensing means for sensing a flexional movement of a wrist of the same hand; and tone generation suppressing means operative while the flexional movement of the wrist is sensed for suppressing the generation of the musical tone through the musical tone controlling means.

13. A musical tone control apparatus comprising; displacement sensing means for sensing a displacement of a part of a player's body from a given position; velocity detecting means for detecting a velocity of the displacement of the part of the player's body according to the sensed displacement; timing detecting means for detecting a timing of a musical tone generation according to the sensed displacement; maximum velocity detecting means operative during a given time interval until the timing of the musical tone generation is detected for detecting a maximum velocity of the displacement of the part of the player's body; and controlling means for commencing the musical tone generation in response to the detected timing and for controlling a tone element of a musical tone to be generated according to the detected maximum velocity.

14. A musical tone control apparatus for controlling a timing of tone generation and a tone element of a musical tone to be generated, the apparatus comprising:

displacement sensing means for sensing a displacement of a part of a player's body;

velocity calculating means for calculating the velocity of the part of the player's body based on the sensed displacement;

stop motion detecting means for detecting a stop motion of the part of the player's body according to the calculated velocity; and controlling means for commencing the tone generation in response to a detection of the stop motion and for controlling a tone element of a musical tone to be generated according to the displacement sensed at the detection of the stop motion.

* * * * *